US007712890B2

(12) United States Patent
Yahiro

(10) Patent No.: US 7,712,890 B2
(45) Date of Patent: May 11, 2010

(54) IMAGE FORMING APPARATUS AND IMAGE FORMING METHOD

(75) Inventor: Yasuko Yahiro, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 517 days.

(21) Appl. No.: 11/806,649

(22) Filed: Jun. 1, 2007

(65) Prior Publication Data

US 2008/0043082 A1 Feb. 21, 2008

(30) Foreign Application Priority Data

Jun. 2, 2006 (JP) ..... 2006-155119

(51) Int. Cl.
*B41J 2/01* (2006.01)

(52) U.S. Cl. ..... 347/103; 347/101

(58) Field of Classification Search ..... 347/101, 347/103

See application file for complete search history.

(56) References Cited

U.S. PATENT DOCUMENTS 6,736,500 B2 5/2004 Takahashi et al.
6,932,469 B2 8/2005 May et al.

FOREIGN PATENT DOCUMENTS

| | | | |
|---|---|---|---|
| JP | 6-40023 | A | 2/1994 |
| JP | 2001-347747 | A | 12/2001 |
| JP | 2003-191599 | A | 7/2003 |
| JP | 2003-266658 | A | 9/2003 |
| JP | 2004-114675 | A | 4/2004 |
| WO | WO 2004/022353 | A1 | 3/2004 |

*Primary Examiner*—Julian D Huffman
(74) *Attorney, Agent, or Firm*—Birch, Stewart, Kolasch & Birch, LLP

(57) ABSTRACT

The image forming apparatus includes: an intermediate transfer body; a first liquid application device which applies a first liquid containing an aggregating agent on the intermediate transfer body; a second liquid application device which applies a second liquid containing a solvent-insoluble material on the intermediate transfer body, the solvent-insoluble material being induced to form an aggregate by the aggregating agent to form an image on the intermediate transfer body; and a transfer device which transfers the image formed on the intermediate transfer body to a recording medium, wherein conditions of $\gamma t>\gamma 2>\gamma 1$ and $\gamma g>\gamma 2>\gamma 1$ are satisfied, where $\gamma t$ is a surface energy of the intermediate transfer body, $\gamma 1$ is a surface energy of the first liquid, $\gamma 2$ is a surface energy of the second liquid, and $\gamma g$ is a surface energy of the aggregate of the solvent-insoluble material.

7 Claims, 17 Drawing Sheets

FIG.10A

| INK LIQUID NO. | PIGMENT | LATEX | SURFACE ENERGY OF COLORING MATERIAL AGGREGATE (mN/m) |
|---|---|---|---|
| 1 | C. I. PIGMENT BLUE 15:3 (5 wt%) | ACRYL LATEX (3 wt%) JURYMER ET-410 MANUFACTURED BY NIHON JUNYAKU | 35.2~47.3 |
| 2 | C. I. PIGMENT BLUE 15:3 (4 wt%) | ACRYL LATEX (8 wt%) JURYMER ET-410 MANUFACTURED BY NIHON JUNYAKU | 35.2~47.3 |
| 3 | C. I. PIGMENT BLUE 15:3 (4 wt%) | STYRENE-ACRYL LATEX (8 wt%) JONCRYL 537 MANUFACTURED BY BASF JAPAN | 35.2~37.9 |

FIG.10B

| TYPE OF INTERMEDIATE TRANSFER BODY | MATERIAL OF INTERMEDIATE TRANSFER BODY | SURFACE ENERGY OF INTERMEDIATE TRANSFER BODY (mN/m) |
|---|---|---|
| A | POLYETHYLENE TEREPHTHALATE (PET) | 43.2 |
| B | POLYETHYLENE NAPHTHALATE (PEN) | 52.9 |
| C | GLASS | 67.6 |

FIG.10C

| INK LIQUID No. | TYPE OF INTERMEDIATE TRANSFER BODY | SURFACE ENERGY (mN/m) | | | | CRITICAL THICKNESS OF MIXED LIQUID (μm) | RELATIONSHIPS | JUDGMENT |
|---|---|---|---|---|---|---|---|---|
| | | INK LIQUID γ2 | INTERMEDIATE TRANSFER BODY γt | COLORING MATERIAL AGGREGATE γg | TREATMENT LIQUID γ1 | | | |
| 1 | A | 33.3 | 43.2 | 35.2~47.3 | 39.1 | 5.6~8.1 | γt>γ1>γ2 and {(γg>γ1>γ2) or(γ1>γg>γ2)} | POOR |
| | A | 33.3 | 43.2 | 35.2~47.3 | 29.7 | 11.4~ | γt>γ2>γ1 and γg>γ2>γ1 | GOOD |
| | A | 33.3 | 43.2 | 35.2~47.3 | 18.2 | 10.2~12.8 | γt>γ2>γ1 and γg>γ2>γ1 | GOOD |
| 2 | A | 32.1 | 43.2 | 35.2~47.3 | 34.7 | 3.8~6.8 | γt>γ1>γ2 and γg>γ1>γ2 | POOR |
| 3 | A | 31.8 | 43.2 | 35.2~37.9 | 34.7 | 5.2~6.9 | γt>γg>γ1>γ2 | POOR |

FIG.11A

| INK LIQUID NO. | PIGMENT | SURFACE ENERGY OF COLORING MATERIAL AGGREGATE (mN/m) |
|---|---|---|
| 1 | C. I. PIGMENT BLUE 15:3 (5 wt%) | 35.2 |

FIG.11B

| INK LIQUID No. | TYPE OF INTERMEDIATE TRANSFER BODY | SURFACE ENERGY (mN/m) | | | | CRITICAL THICKNESS OF MIXED LIQUID (μm) | RELATIONSHIPS | JUDGMENT |
|---|---|---|---|---|---|---|---|---|
| | | INK LIQUID γ2 | INTERMEDIATE TRANSFER BODY γt | COLORING MATERIAL AGGREGATE γg | TREATMENT LIQUID γ1 | | | |
| 1 | A | 31.2 | 52.9 | 35.2 | 28.0 | 10.5~ | γt>γg>γ2>γ1 | GOOD |
| | B | 31.2 | 52.9 | 35.2 | 28.0 | 7.8~14.8 | γt>γg>γ2>γ1 | FAIR |
| | C | 31.2 | 67.6 | 35.2 | 28.0 | 15.4~15.6 | γt>γg>γ2>γ1 | EXCELLENT |

FIG.12A

| INK LIQUID NO. | LATEX | SURFACE ENERGY OF COLORING MATERIAL AGGREGATE (mN/m) |
|---|---|---|
| 1 | ACRYL LATEX (5 wt%) JURYMER ET-410 MANUFACTURED BY NIHON JUNYAKU | 47.3 |
| 2 | STYRENE-ACRYL LATEX (5 wt%) JONCRYL 537 MANUFACTURED BY BASF JAPAN | 37.9 |

FIG.12B

| INK LIQUID No. | TYPE OF INTERMEDIATE TRANSFER BODY | SURFACE ENERGY (mN/m) | | | | CRITICAL THICKNESS OF MIXED LIQUID (μm) | RELATIONSHIPS | JUDGMENT |
|---|---|---|---|---|---|---|---|---|
| | | INK LIQUID γ2 | INTERMEDIATE TRANSFER BODY γt | COLORING MATERIAL AGGREGATE γg | TREATMENT LIQUID γ1 | | | |
| 1 | B | 31.6 | 52.9 | 47.3 | 28.0 | 6.9~9.4 | γt>γg>γ2>γ1 | FAIR |
| 2 | B | 31.7 | 52.9 | 37.9 | 28.0 | 9.6~10.0 | γt>γg>γ2>γ1 | GOOD |

FIG.13A

| INK LIQUID NO. | PIGMENT | LATEX | SURFACE ENERGY OF COLORING MATERIAL AGGREGATE (mN/m) |
|---|---|---|---|
| 3 | C. I. PIGMENT BLUE 15:3 (4 wt%) | STYRENE-ACRYL LATEX (8 wt%) JONCRYL 537 MANUFACTURED BY BASF JAPAN | 35.2~37.9 |

FIG.13B

| MATERIAL OF INTERMEDIATE TRANSFER BODY | FLUOROCARBON ELASTOMER | SILICONE RUBBER | POLYPROPYLENE | POLYIMIDE |
|---|---|---|---|---|
| SURFACE ENERGY OF INTERMEDIATE TRANSFER BODY (mN/m) | 13.6 | 11.4 | 25~35 | 34.7 |
| TRANSFER RATE (%) TRANSFER TEMPERATURE:80°C CONVEYANCE SPEED:10mm/sec | 100 | 100 | 60 | 50 |
| TRANSFER RATE (%) TRANSFER TEMPERATURE:80°C CONVEYANCE SPEED:500mm/sec | 90 | 90 | 30 | 20 |
| TRANSFER CHARACTERISTICS | EXCELLENT | EXCELLENT | GOOD | FAIR |

IMAGE FORMING APPARATUS AND IMAGE FORMING METHOD

BACKGROUND OF THE INVENTION

1. Field of the Invention

The present invention relates to an image forming apparatus and image forming method, and more particularly, to an inkjet recording apparatus in which solvent removal and image transfer can be performed without causing image disturbance, by provisionally fixing a solvent-insoluble material, such as coloring material, on an intermediate transfer body prior to the solvent removal and image transfer.

2. Description of the Related Art

An inkjet recording apparatus is provided with an inkjet head (which is hereinafter simply referred to as a "head") having an ink ejection part including nozzles manufactured by using a high-precision processing technique, still it is difficult to print images on a large number of sheets at high speed by means of a direct recording method known in the related art, under the ejection conditions that have become extremely. Therefore, an inkjet method of intermediate transfer type has been proposed in order to improve reliability.

In the inkjet method of intermediate transfer type, an image is formed on a recording medium by forming a print image on the intermediate transfer body and then transferring the print image to the recording medium. In order to prevent disturbance of the image on the recording medium, process from the forming step of the print image on the intermediate transfer body to the transferring step of the image to the recording medium is important. In view of these circumstances, there is the following related art, for example.

Japanese Patent Application Publication No. 06-040023 discloses that liquid composed of an oil-based solvent and colored charged particles dispersed therein is deposited on the intermediate transfer body connected to earth, whereupon ions having the same polarity as the colored charged particles are applied. Thereby, the colored charged particles receive electrostatic force and move toward the surface of the intermediate transfer body, thus becoming provisionally fixed. However, this essentially utilizes the electrophoresis, then no solvent can be used other than the oil-based solvent having high insulating properties.

Japanese Patent Application Publication No. 2001-347747 discloses that a material which increases the viscosity when coming into contact with an ink liquid is deposited on the intermediate transfer body. The viscosity of the ink liquid is thereby adjusted so that the ink liquid sufficiently has both transferability from the intermediate transfer body to the recording medium and adhesiveness to the recording medium. This reference concentrates on the transfer conditions; however, it makes no mention of the provisional fixing of the coloring material contained in the ink liquid onto the intermediate transfer body, prior to the image transfer.

Japanese Patent Application Publication No. 2003-266658 discloses that a recording medium is laminated from a fixing layer and a permeable layer, a sublimating ink is deposited onto the permeable layer to form an image, the recording medium is then heated to transfer the image formed on the permeable layer to the fixing layer, whereupon the film of the permeable layer is peeled and removed from the recording medium. The recording medium is not reusable since the film of the permeable layer used for carrying out the image transfer is ultimately removed. Moreover, since the recording medium must have the permeable layer, there is no versatility in terms of the recording medium.

Japanese Patent Application Publication No. 2004-114675 discloses that a first material for improving the wetting properties is applied on the intermediate transfer body, a second material for reducing the fluidity of the ink is applied over the first material, then an image is formed on the intermediate transfer body by depositing the ink with an inkjet head, whereupon the image is transferred from the intermediate transfer body to the recording medium. Here, the coloring material is not fixed on the intermediate transfer body even provisionally, and hence there is a possibility that the coloring material is displaced and the image disturbance occurs, when transferring the coloring material to the recording medium.

Japanese Patent Application Publication No. 2003-191599 discloses an inkjet recording apparatus of intermediate transfer type constituted of an aggregate formation zone, an excess solvent removal zone, and an image transfer zone. In this inkjet recording apparatus, the coloring material is aggregated before removing the solvent, but not fixed on the intermediate transfer body even provisionally, and the image disturbance may occur when the solvent is removed.

SUMMARY OF THE INVENTION

The present invention has been contrived in view of these circumstances, an object thereof being to provide an image forming apparatus and an image forming method whereby it is possible to prevent the image disturbance during removing solvent and transferring an image to the recording medium, by provisionally fixing the aggregate of a solvent-insoluble material (coloring material) on the intermediate transfer body before removing the solvent and transferring the image to the recording medium, the image forming apparatus and the image forming method being compatible with both oil-based and water-based liquids, such as ink liquids, without generating wasteful expendable material, while allowing high versatility in terms of the recording medium.

In order to attain the aforementioned object, the present invention is directed to an image forming apparatus comprising: an intermediate transfer body; a first liquid application device which applies a first liquid containing an aggregating agent on the intermediate transfer body; a second liquid application device which applies a second liquid containing a solvent-insoluble material on the intermediate transfer body, the solvent-insoluble material being induced to form an aggregate by the aggregating agent to form an image on the intermediate transfer body; and a transfer device which transfers the image formed on the intermediate transfer body to a recording medium, wherein conditions of $\gamma t>\gamma 2>\gamma 1$ and $\gamma g>\gamma 2>\gamma 1$ are satisfied, where $\gamma t$ is a surface energy of the intermediate transfer body, $\gamma 1$ is a surface energy of the first liquid, $\gamma 2$ is a surface energy of the second liquid, and $\gamma g$ is a surface energy of the aggregate of the solvent-insoluble material.

According to this aspect of the present invention, since the aggregate of the solvent-insoluble material is provisionally fixed on the intermediate transfer body, under the conditions of $\gamma t>\gamma 2>\gamma 1$ and $\gamma g>\gamma 2>\gamma 1$, then it is possible to prevent the image disturbance during transfer of the image to the recording paper. Moreover, it is also possible to handle various types of liquids as the first liquid and the second liquid, rather than being limited to oil-based or water-based liquids only. Furthermore, it is possible to prevent the generation of the wasted expendable material, and there is no limitation on the recording medium which can be handled, and hence versatility is high in terms of the recording medium.

"Provisional fixing" means that an adhesive force, such as an intermolecular force, a hydrogen bonding force or a chemical bonding force, acts directly between the intermediate transfer body and the aggregate of the solvent-insoluble material that is the transferred material (a material to be transferred to the recording medium). Moreover, "provisional fixing" includes not only a state where the aggregate of the solvent-insoluble material is directly in contact with the intermediate transfer body, but also a state where the aggregate of the solvent-insoluble material is indirectly in contact with the intermediate transfer body (a state where the aggregate of the solvent-insoluble material is deposited on the intermediate transfer body at a distance of not greater than 10 μm).

For the first liquid application device and the second liquid application device, it is preferable to use an inkjet type of ejection heads which eject the first liquid and the second liquid on the basis of the image information (print data) for recording.

The first liquid application device and the second liquid application device in the image forming apparatus according to the present invention may have a composition of a full line type inkjet head having a nozzle row in which a plurality of nozzles (ejection ports) are arranged through a length corresponding to the full width of the recording medium. In this case, a mode may be adopted in which a plurality of relatively short ejection head modules each having nozzle rows that do not reach a length corresponding-to the full width of the recording medium are combined and joined together, thereby forming nozzle rows of a length corresponding to the full width of the recording medium.

The full line type inkjet head is generally disposed in a direction that is perpendicular to the relative feed direction (relative conveyance direction) of the recording medium, but a mode may also be adopted in which the inkjet head is disposed following an oblique direction that forms a prescribed angle with respect to the direction perpendicular to the conveyance direction.

Furthermore, when forming color images, it is possible to provide a full line type recording head for each color of a plurality of colored inks (recording liquids), or it is possible to provide a single recording head for ejecting inks of a plurality of colors.

The first liquid application device may also apply the first liquid by means of an application roller, or the like.

"Recording medium" indicates a medium to which an image is transferred by means of the recording medium transfer device (this medium may also be called a print medium, image forming medium, recording medium, image receiving medium, media, or the like). The recording medium includes various types of media, irrespective of material and size, such as continuous paper, cut paper, sealed paper, resin sheets such as OHP sheets, film, cloth, and a printed circuit board on which a wiring pattern, or the like, is formed.

Preferably, a condition of $\gamma t>\gamma g>\gamma 2>\gamma 1$ is satisfied.

According to this aspect of the present invention, by satisfying the condition of $\gamma t>\gamma g>\gamma 2>\gamma 1$, the aggregate of the solvent-insoluble material is fixed provisionally on the intermediate transfer body, in a reliable fashion, and hence it is possible to prevent the image disturbance during transfer of an image to the recording medium.

Preferably, the image forming apparatus further comprises a surface energy adjusting device which adjusts at least one of the surface energies $\gamma g$ and $\gamma t$ so that a condition of $\gamma g>\gamma t$ is satisfied when the transfer device transfers the image to the recording medium.

According to this aspect of the present invention, the surface energy adjusting device adjusts at least one of the surface energies $\gamma g$ and $\gamma t$ so that the condition of $\gamma g>\gamma t$ is satisfied, and the aggregate of the solvent-insoluble material therefore becomes more readily transferable to the recording medium.

Preferably, the solvent-insoluble material is one of a pigment and a polymer.

According to this aspect of the present invention, since the solvent-insoluble material is a pigment or a polymer, then the transfer characteristics to the recording medium are improved, and the fixing properties and the wear resistance on the recording medium after transfer are improved.

Preferably, the first liquid application device includes an ejection head.

According to this aspect of the present invention, since the first liquid is deposited on the intermediate transfer body by means of the ejection head, it is possible to cause the first liquid to wet and spread over the intermediate transfer body.

Preferably, the image forming apparatus further comprises a solvent removal device which removes solvent from a mixed liquid of the first liquid and the second liquid.

According to this aspect of the present invention, since the solvent removal device for removing the solvent from the mixed liquid is provided, then it is possible reliably to prevent the image disturbance during transfer of the image to the recording medium.

In order to attain the aforementioned object, the present invention is also directed to an image forming method of forming an image on a recording medium, the method comprising the steps of: applying a first liquid containing an aggregating agent on an intermediate transfer body; applying a second liquid containing a solvent-insoluble material on the intermediate transfer body, the solvent-insoluble material being induced to form an aggregate by the aggregating agent to form an image on the intermediate transfer body, under conditions of $\gamma t>\gamma 2>\gamma 1$ and $\gamma g>\gamma 2>\gamma 1$, where $\gamma t$ is a surface energy of the intermediate transfer body, $\gamma 1$ is a surface energy of the first liquid, $\gamma 2$ is a surface energy of the second liquid, and $\gamma g$ is a surface energy of the aggregate of the solvent-insoluble material; and transferring the image formed on the intermediate transfer body to the recording medium.

According to the present invention, it is possible to provide an image forming apparatus and an image forming method whereby it is possible to prevent the image disturbance during removing solvent and transferring an image to the recording medium, by provisionally fixing the aggregate of the solvent-insoluble material (coloring material) on the intermediate transfer body before removing the solvent and transferring an image to the recording medium, the image forming apparatus and the image forming method being compatible with both oil-based and water-based liquids, such as ink liquids, without generating wasteful expendable material, while allowing high versatility in terms of the recording medium.

BRIEF DESCRIPTION OF THE DRAWINGS

The nature of the present invention, as well as other objects and benefits thereof, will be explained in the following with reference to the accompanying drawings, in which like reference characters designate the same or similar parts throughout the figures and wherein:

FIGS. 10A to 10C are tables showing conditions and results of evaluation of dot displacement on the intermediate transfer body after conveyance;

FIGS. 11A and 11B are tables showing other conditions and results of evaluation of dot displacement on the intermediate transfer body after conveyance;

FIGS. 12A and 12B are tables showing yet other conditions and results of evaluation of dot displacement on the intermediate transfer body after conveyance;

FIGS. 13A and 13B are tables showing conditions and results of evaluation of transfer characteristics to the recording medium;

DETAILED DESCRIPTION OF THE PREFERRED EMBODIMENTS

Composition of Inkjet Recording Apparatus

Figure 1:
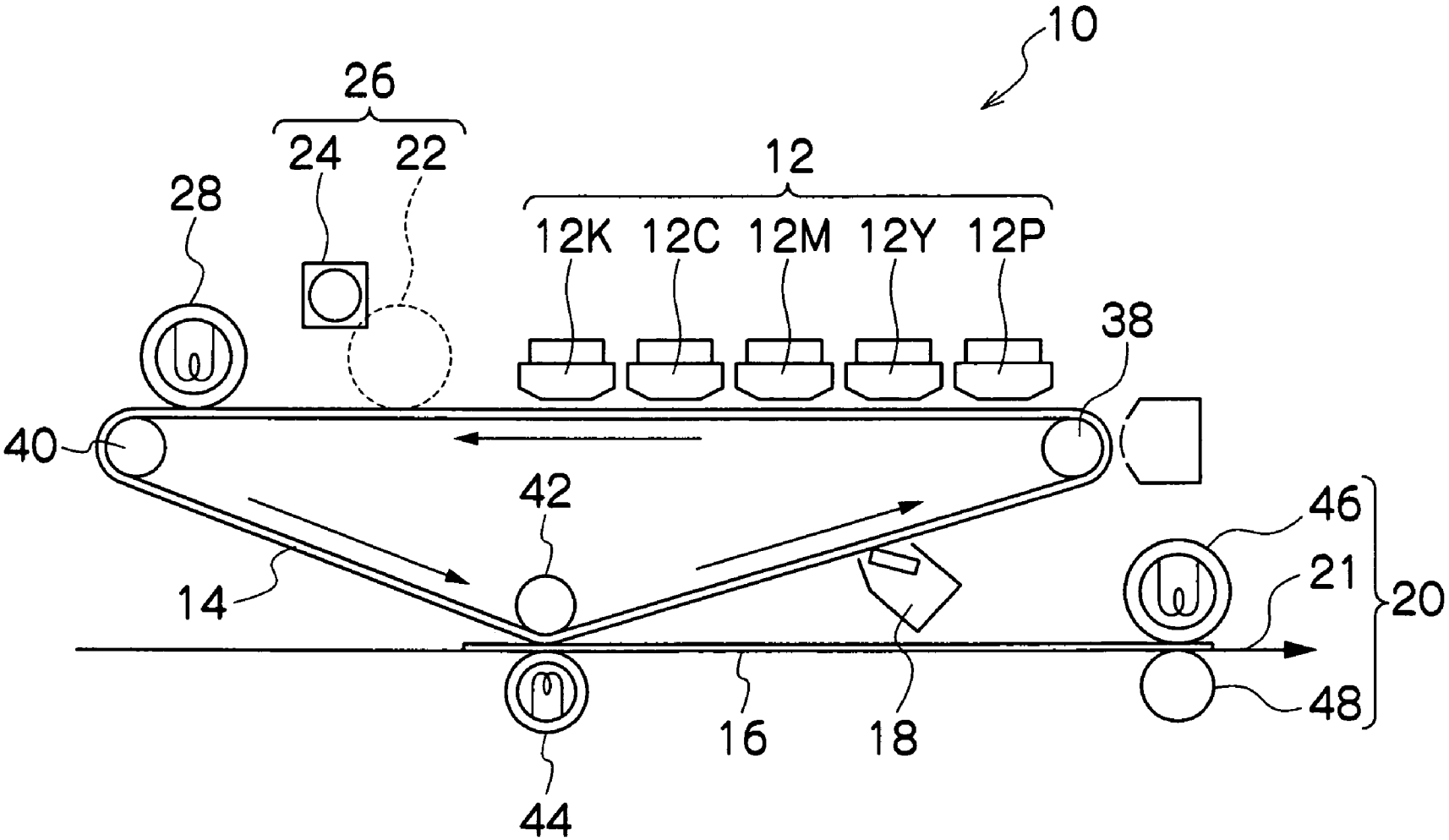
FIG. 1 is a general schematic drawing showing an inkjet recording apparatus that forms an image forming apparatus according to an embodiment of the present invention.

FIG. 1 is a general schematic drawing showing an inkjet recording apparatus according to an embodiment of the present invention. The inkjet recording apparatus 10 includes an intermediate transfer body, a liquid application device, a solvent removal and drying device, a transfer device, a cleaning device, a fixing device, and the like.

As shown in FIG. 1, the liquid application device includes a print unit 12, which has a plurality of inkjet heads (hereinafter, called "heads") 12P, 12Y, 12M, 12C, and 12K respectively corresponding to a treatment liquid (P) forming a first liquid, and four inks of yellow (Y), magenta (M), cyan (C) and black (K) forming second liquids. In the present embodiment, the head 12P is used as a device for applying the treatment liquid, but apart from this, it is also possible to apply the treatment liquid by means of an application roller (not illustrated), or the like.

In order to apply the treatment liquid in a uniform film thickness, it is desirable that a treatment liquid thickness control unit is provided, which controls the film thickness of the treatment liquid with high accuracy after the treatment liquid is applied. The extent of ink spread is highly dependent on the film thickness of the treatment liquid. It is preferable that the treatment liquid is applied to a large thickness, and the film thickness treatment liquid is then made uniform by scraping the surplus liquid with a hot blade or drying the surplus liquid, particularly in the case of the target film thickness of 1 μm or less. The treatment liquid thickness control unit preferably includes a blade or a treatment liquid drying unit.

The intermediate transfer body 14 is formed into an endless belt shape and is set around rollers 38 and 40, and a transfer pressurization roller 42. Preferred embodiments of the material of the intermediate transfer body 14 are commonly known materials that are generally used for the transfer body having an endless belt shape, for example, a polyurethane resin, a polyester resin, a polystyrene resin, a polyolefin resin, a polybutadiene resin, a polyamide resin, a polyvinyl chloride resin, a polyethylene resin, a polyfluorocarbon resin, a polyimide resin, a silicone resin, and the like. It is also possible to provide a resistance adjusting layer in which a suitable conductive material is dispersed, on the surface of the endless belt made of the above-described material, and the composition of a normal intermediate transfer body may be adopted. Furthermore, for the intermediate transfer body 14, it is also preferable to use an endless belt made of electroformed nickel on which a silicone rubber film or a polyfluorocarbon rubber film is formed so as to improve separating properties. In the present embodiment, an endless belt-shaped member is used, but the present invention is not limited to this, and it is also possible to use a drum-shaped member, for example.

The solvent removal member includes: a solvent removal unit 26 constituted of an absorbing roller 22, a recovery section 24, and the like; and a solvent drying unit 28. The solvent removal method employed in the solvent removal unit 26 may be, for example, a method in which a porous member in the form of a roller is abutted against the intermediate transfer body 14, a method in which excess solvent is removed from the intermediate transfer body 14 by means of an air knife, a method in which the solvent is evaporated and removed by heating, or the like. In the present embodiment, a method is used in which a ceramic porous material (a material formed by sintering alumina particles) is abutted against the intermediate transfer body 14. By adopting this solvent removal device, even if a large amount of treatment liquid is applied on the intermediate transfer body 14, then it is possible to prevent large amounts of the dispersion medium from being transferred to the recording paper 16 since the solvent is removed by the solvent removal unit 26. Consequently, it is possible to prevent curling, cockling, and the like, of the recording paper 16 that are liable to occur in the case of water-based solvents.

A conveyance unit 20, which conveys the recording paper 16 while holding the recording paper 16 flat, is arranged opposite the intermediate transfer body 14 and the transfer body cleaning unit 18 for cleaning the intermediate transfer body 14.

Two transfer pressurization rollers 42 and 44 forming the transfer device nip the intermediate transfer body 14 and the recording paper 16, therebetween. Although the principal function of the transfer device is pressurization, the transfer pressurization roller 44 is also provided with a heating function.

The conveyance unit 20 includes a belt 21, and the belt 21 is interposed between the transfer pressurization rollers 42 and 44, and between the fixing pressurization rollers 46 and 48. The recording paper 16 is held on the belt 21 of the conveyance unit 20 and is conveyed from left to right in FIG.

1. Thereupon, the recording paper 16 is heated by a heating function of the fixing pressurization roller 46 and the image formed on the conveyance recording paper 16 is fixed.

Figure 14A:
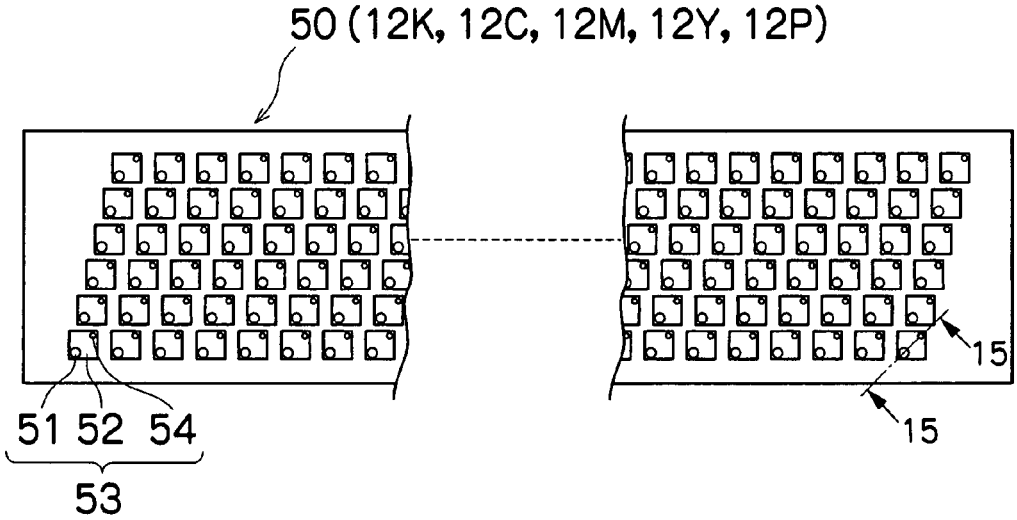
FIG. 14A is a plan view perspective diagram showing an embodiment of the composition of a head.

The heads 12P, 12Y, 12M, 12C and 12K of the print unit 12 each have a length corresponding to the maximum width of the intermediate transfer body 14, and the heads each are full-line heads in which a plurality of nozzles for ejecting inks are arranged in the nozzle surface of the head (see FIG. 14A).

The heads 12P, 12Y, 12M, 12C and 12K are arranged in the following order: treatment liquid (P), yellow (Y), magenta (M), cyan (C) and black (K) from the upstream side in the conveyance direction of the intermediate transfer body 14. These heads 12P, 12Y, 12M, 12C and 12K are arranged extending in a direction substantially perpendicular to the conveyance direction of the intermediate transfer body 14.

Firstly, the treatment liquid containing an aggregating agent is ejected from the head 12P while the intermediate transfer body 14 is conveyed, and the ink liquids containing coloring materials of different colors are ejected respectively from the heads 12Y, 12M, 12C and 12K, thereby forming a mixed liquid of the treatment liquid and each of the ink liquids on the intermediate transfer body 14. Thereupon, the coloring material is made to aggregate by the aggregating agent to form a coloring material aggregate in the mixed liquid. Thereby, a color image is formed on the intermediate transfer body. Then, the liquid portion of the mixed liquid is removed by the solvent removal unit 26, and the coloring material aggregate on the intermediate transfer body 14 is transferred to the recording paper 16 that is conveyed by the conveyance unit 20, and consequently a color image can be formed on the recording paper 16.

In this way, by adopting a configuration in which the full line heads 12K, 12C, 12M and 12Y are respectively provided for the four colors, and the full line heads each have nozzle rows covering the full width of the intermediate transfer body 14 that is used for the image transfer to ultimately form an image on the recording medium, it is possible to record an image on the full surface of the recording paper 16 by performing just one operation of moving the intermediate transfer body 14 and the print unit 12 relatively to each other, in the conveyance direction of the intermediate transfer body 14 (in other words, by means of one sub-scanning action). Higher-speed printing is thereby made possible and productivity can be improved in comparison with a shuttle type head configuration in which the recording head moves back and forth reciprocally in a direction perpendicular to the conveyance direction of the intermediate transfer body 14.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. There are no particular restrictions of the sequence in which the heads of respective colors are arranged. Moreover, it is possible to add a transparent ink that has no color, or a white ink that can be used as an undercoat applied on a transparent substrate.

Furthermore, in order to improve the transfer rate during the image transfer and to control the luster of the image surface, it is also possible to apply heat during carrying out the image transfer.

Conditions for Formation of Image on Intermediate Transfer Body

Next, the image formation conditions according to an embodiment of the present invention, during forming a transfer image (an image to be ultimately transferred to the recording medium) on the intermediate transfer body, are described. As described below, the image formation conditions are optimized so that certain relationships between surface energies of materials are met.

Firstly, in order for the treatment liquid 30 to wet and spread across the intermediate transfer body 14 when the treatment liquid 30 forming the first liquid is applied on the intermediate transfer body 14 by the head 12P, it is preferable that there is the following relationship (1) between the surface energy $\gamma t$ of the intermediate transfer body 13 and the surface energy $\gamma 1$ of the treatment liquid 30:

$$\gamma t > \gamma 1. \quad (1)$$

Figure 2A:
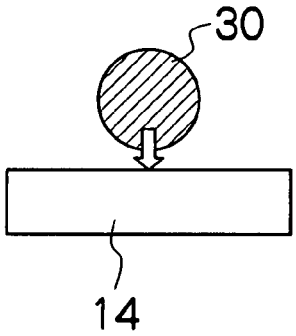
FIGS. 2A to 2C are diagrams for describing a case where treatment liquid is deposited under a preferable condition of an intermediate transfer body and the treatment liquid.
Figure 2B:
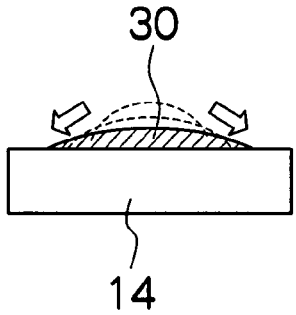
Figure 2C:
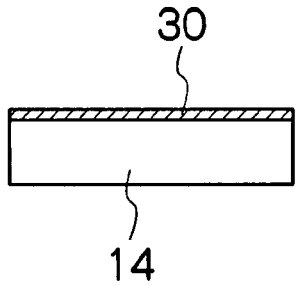

When the condition (1) is satisfied, it is possible to apply the treatment liquid 30 to a uniform thickness on the intermediate transfer body 14. FIGS. 2A to 2C are diagrams showing states where the treatment liquid 30 is spreading over the intermediate transfer body 14 under the condition (1). As shown in FIG. 2A, a droplet of the treatment liquid 30 is about to deposit on the intermediate transfer body 14. Thereupon, the treatment liquid 30 wets and spreads due to the inertial force upon depositing on the intermediate transfer body 14, and moreover, the treatment liquid 30 wets and spreads so as to cover the surface of the intermediate transfer body 14 in such a manner that the total energy is reduced, as shown in FIG. 2B. The contact angle of the treatment liquid 30 on the intermediate transfer body 14 becomes thus smaller, and approaches zero. Consequently, as shown in FIG. 2C, the treatment liquid 30 wets and spreads over the intermediate transfer body 14, and the treatment liquid 30 can be applied to a relatively uniform thickness on the intermediate transfer body 14.

Figure 3A:
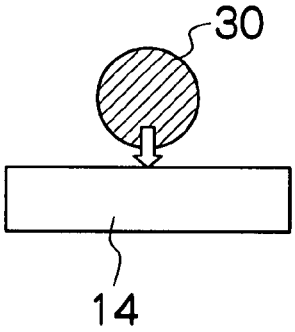
FIGS. 3A to 3C are diagrams for describing a case where the treatment liquid is deposited under another condition of the intermediate transfer body and the treatment liquid.
Figure 3B:
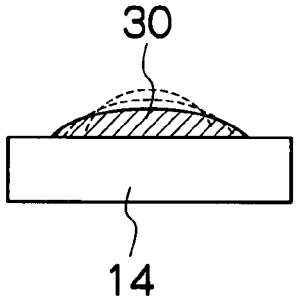
Figure 3C:
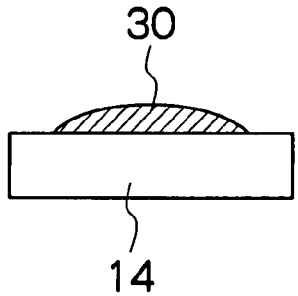

Here, supposing that the relationship of the surface energies is $\gamma t = \gamma 1$, which does not satisfy the condition (1). FIGS. 3A to 3C are diagrams showing states where the treatment liquid is spreading over the intermediate transfer body 14 under this condition. As shown in FIG. 3A, a droplet of the treatment liquid 30 is about to deposit on the intermediate transfer body 14. Thereupon, the treatment liquid 30 seeks to spread due to the inertial force upon the deposition, but the spreading is terminated in the state shown in FIG. 3B. Consequently, as shown in FIG. 3C, the treatment liquid 30 does not wet and spread over the intermediate transfer body 14 but rather forms a droplet.

Figure 4A:
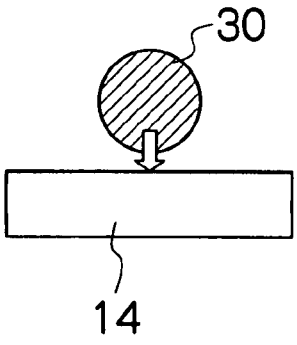
FIGS. 4A to 4C are diagrams for describing a case where the treatment liquid is deposited under yet another condition of the intermediate transfer body and the treatment liquid.
Figure 4B:
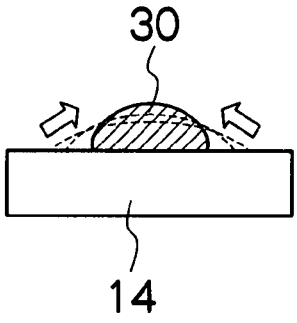
Figure 4C:
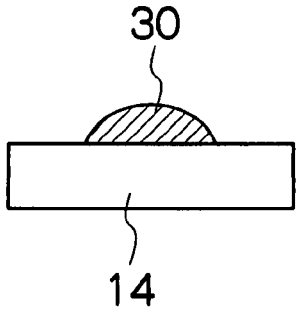

Moreover, supposing that the relationship of the surface energies is $\gamma t < \gamma 1$, which does not satisfy the condition (1). FIGS. 4A to 4C are diagrams showing states where the treatment liquid is spreading over the intermediate transfer body 14 under this condition. As shown in FIG. 4A, a droplet of the treatment liquid 30 is about to deposit on the intermediate transfer body 14. Thereupon, the treatment liquid 30 seeks to spread due to the inertial force upon the deposition, but it contracts in order to reduce the surface area, as indicated by the arrows in FIG. 4B. Consequently, as shown in FIG. 4C, the treatment liquid 30 does not wet and spread over the intermediate transfer body 14 but rather forms a droplet.

As described above, by setting the condition as indicated by the inequality (1), it is possible to apply the treatment liquid 30 to a uniform thickness on the intermediate transfer body 14.

It is desirable that the surface energy $\gamma t$ of the intermediate transfer body 14 is raised before the treatment liquid 30 is applied on the intermediate transfer body 14, so that the treatment liquid 30 can have a uniform thickness on the intermediate transfer body 14 more readily, and also the image formed on the intermediate transfer body 14 can be transferred to the recording paper 16 more readily as described later. Specific examples of methods to raise the surface energy $\gamma t$ of the intermediate transfer body 14 include: heating the intermediate transfer body 14, irradiating the intermediate transfer body 14 with ultraviolet light, and applying charge on the intermediate transfer body 14 with corona discharge.

Next, in order for the deposited ink liquid to stably form a droplet 31 in the treatment liquid 30, it is preferable that there is the following relationship (2) between the surface energy $\gamma 1$ of the treatment liquid 30 and the surface energy $\gamma 2$ of the ink droplet 31:

$$\gamma 2 > \gamma 1. \quad (2)$$

When the condition (2) is satisfied, since there is an interfacial tension difference between the treatment liquid 30 and the ink droplet 31, then the tension of the interface between the treatment liquid 30 and the ink droplet 31 acts upon the ink droplet 31 in the treatment liquid 30 so as to reduce the interfacial area of the ink droplet 31, and the ink droplet 31 thus seeks to assume a sphere, and improved dot shape can be achieved. Moreover, since the tensile force of the treatment liquid 30 that acts upon and pulls the ink droplet 31 is small, then the ink droplet 31 is not moved in the treatment liquid 30. Thus, the droplet 31 of the deposited ink liquid can be stably formed in the treatment liquid 30, and the provisional fixing of the dot is enhanced.

If the relationship of the surface energies is $\gamma 2 = \gamma 1$, which does not satisfy the condition (2), since there is no interfacial tension difference between the treatment liquid 30 and the ink droplet 31, then no tension of the interface between the treatment liquid 30 and the ink droplet 31 acts upon the ink droplet 31 in the treatment liquid 30 so as to reduce the interfacial area of the ink droplet 31, the ink droplet 31 does not assume a sphere, and consequently the dot shape is disturbed.

If the relationship of the surface energies is $\gamma 2 < \gamma 1$, which does not satisfy the condition (2), there exists the interfacial tension difference between the treatment liquid 30 and the ink droplet 31, but the tension of the interface between the treatment liquid 30 and the ink droplet 31 acts upon the ink droplet 31 in the treatment liquid 30 so as not to reduce the interfacial area of the ink droplet 31, then the ink droplet 31 does not assume a sphere shape, and consequently the dot shape is further disturbed. Moreover, since the tensile force of the treatment liquid 30 that acts upon and pulls the ink droplet 31 is large, then the ink droplet 31 is readily moved in the treatment liquid 30, resulting in difficulty of provisionally fixing the dot.

There may be a case where the concentration of the surfactant in the treatment liquid 30 assumes a local ununiformity due to the effects of drying, and the like, and a current is generated inside the treatment liquid 30 by the interfacial tension difference due to the local ununiformity of the surfactant concentration. Even in this case, if the condition (2) is satisfied, then the ink droplet 31 is not moved by the treatment liquid 30, the droplet 31 of the deposited ink liquid is stably formed in the treatment liquid 30, and consequently the provisional fixing of the dot is enhanced. On the other hand, if the condition (2) is not satisfied, then the ink droplet 31 is moved by the treatment liquid 30, the droplet 31 of the deposited ink liquid is made unstable in the treatment liquid 30, and consequently the provisional fixing of the dot is inhibited.

Next, in order to achieve an aggregation state of the coloring material suitable for fixing the transfer image on the intermediate transfer body 14, it is preferable that there is the following relationship (3) between the surface energy $\gamma g$ of the coloring material aggregate 34 and the surface energy $\gamma 1$ of the treatment liquid 30:

$$\gamma g > \gamma 1. \quad (3)$$

Figure 5A:
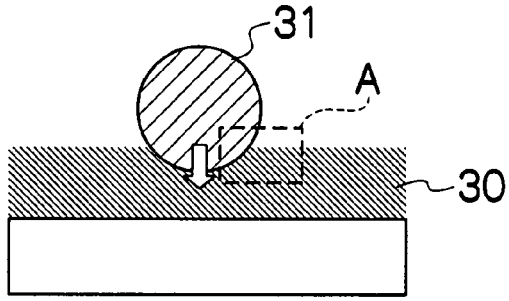
FIGS. 5A to 5D are diagrams for describing relationships between the surface energies of a coloring material aggregate and the treatment liquid.
Figure 5B:
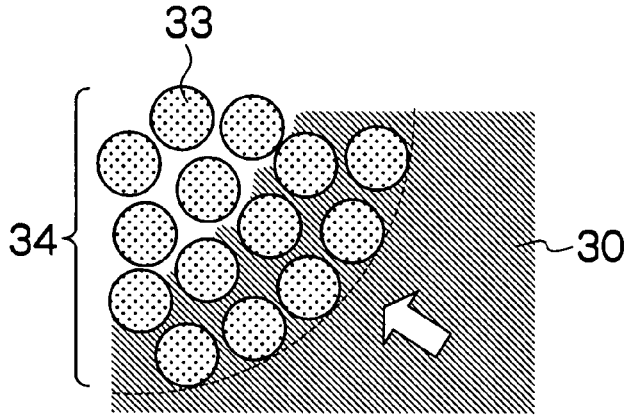
Figure 5C:
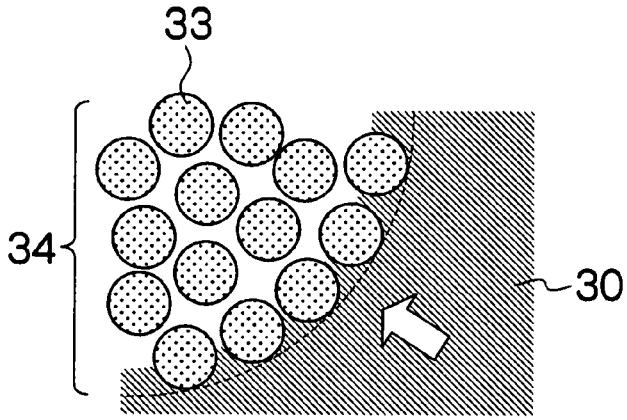
Figure 5D:
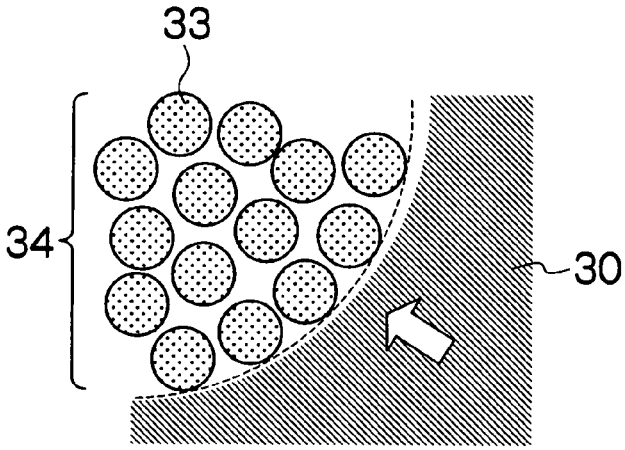

FIGS. 5A to 5D are diagrams showing the relationships between the surface energy $\gamma g$ of the coloring material aggregate 34 and the surface energy $\gamma 1$ of the treatment liquid 30; FIGS. 5B to 5D are enlarged diagrams of the region A in FIG. 5A. As shown in FIG. 5A, the ink droplet 31 is being deposited on the treatment liquid 30. When particles of coloring material 33 in the ink droplet 31 form the coloring material aggregate 34, if the condition (3) is satisfied, then the treatment liquid 30 wets the boundary surface of the coloring material aggregate that is an intermediate product of the aggregation, and the aggregation further progresses inside the coloring material aggregate, as shown in FIG. 5B. Therefore, the coloring material aggregate 34 is uniformly formed and an aggregation state that is suitable for fixing the transfer image on the intermediate transfer body 14 is achieved.

If the relationship of the surface energies is $\gamma g = \gamma 1$, which does not satisfy the condition (3), then as shown in FIG. 5C, the treatment liquid 30 does not wet and spread over the boundary surface of the intermediate aggregate, and the aggregation progress is therefore inhibited at the vicinity of the surface of the intermediate aggregate, resulting in non-uniformity of the aggregation state. Consequently, the fixing properties of the transfer image on the intermediate transfer body 14 are liable to become unsatisfactory.

If the relationship of the surface energies is $\gamma g < \gamma 1$, which does not satisfy the condition (3), then as shown in FIG. 5D, the treatment liquid 30 is repelled from the boundary surface of the intermediate aggregate, and the reaction progress is therefore inhibited at the vicinity of the surface of the intermediate aggregate, resulting in the non-uniformity of the aggregation state. Consequently, the fixing properties of the transfer image on the intermediate transfer body 14 are liable to become more unsatisfactory.

Next, the conditions suitable for separating a mixed liquid 32, which is composed of the treatment liquid 30 and the ink liquid 31, from the coloring material aggregate 34 on the intermediate transfer body 14 are described below.

Firstly, it is preferable that there is the following relationship (4) between the surface energy $\gamma k$ of the mixed liquid 32 and the surface energy $\gamma g$ of the coloring material aggregate 34:

$$\gamma g > \gamma k. \quad (4)$$

Figure 6A:
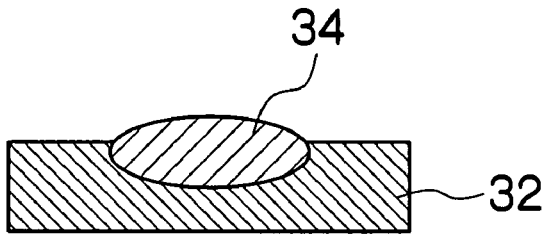
FIGS. 6A to 6D are diagrams for describing relationships between the surface energies of a mixed liquid and the coloring material aggregate.

FIG. 6A is a diagram showing an initial state where the mixed liquid 32 and the coloring material aggregate 34 are formed after the ink liquid 31 is deposited on the treatment liquid 30. In this case, if the condition (4) is satisfied, then, from the initial state shown in FIG. 6A, the coloring material aggregate 34 becomes completely surrounded by the mixed liquid 32 as shown in FIG. 6D, and the aggregation in the coloring material aggregate 34 progresses in this state. Consequently, the aggregation sufficiently progresses, and it is possible to sufficiently separate the mixed liquid 32 from the coloring material aggregate 34.

Figure 6B:
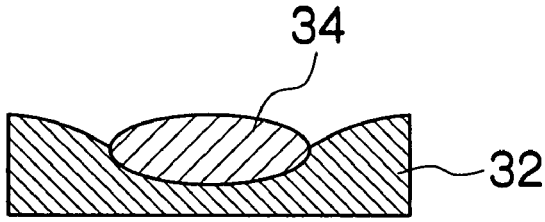
Figure 6C:
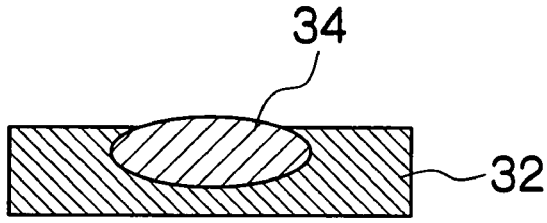
Figure 6D:
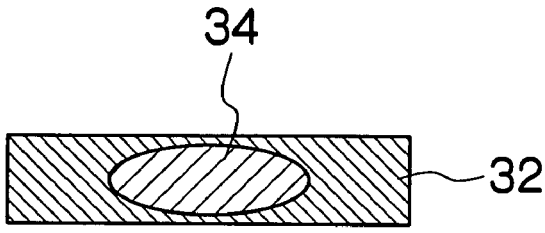

If the relationship of the surface energies is $\gamma g < \gamma k$, which does not satisfy the condition (4), then the mixed liquid 32 is repelled from the coloring material aggregate 34 as shown in FIG. 6B. If the relationship of the surface energies is $\gamma g = \gamma k$, which does not satisfy the condition (4), then, seeking to minimize the total energy, the coloring material aggregate 34 stays at the air-liquid interface so as to minimize its interfacial area, as shown in FIG. 6C. In these cases, the aggregation in the coloring material aggregate 34 does not progress to a sufficient extent.

Next, it is preferable that there is the following relationship (5) between the surface energy γk of the mixed liquid 32 and the surface energy γt of the intermediate transfer body 14:

$$\gamma t > \gamma k. \quad (5)$$

Figure 7A:
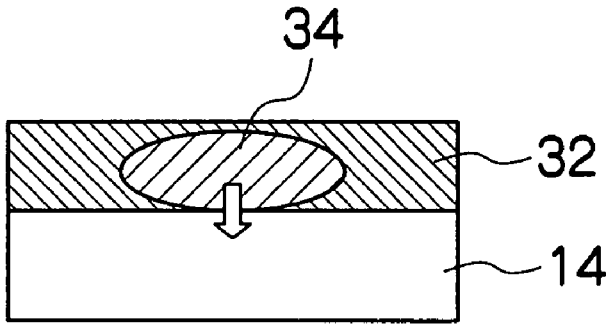
FIGS. 7A to 7D are diagrams for describing relationships between the surface energies of the mixed liquid and the intermediate transfer body.

FIG. 7A is a diagram showing an initial state where the mixed liquid 32 and the coloring material aggregate 34 are formed on the intermediate transfer body 14 after the ink liquid 31 is deposited on the treatment liquid 30. In this case, if the condition (5) is satisfied, then, from the initial state shown in FIG. 7A, the coloring material aggregate 34 becomes completely surrounded by the mixed liquid 32 as shown in FIG. 7D, the aggregation in the coloring material aggregate 34 further progresses in this state, and the coloring material aggregate 34 is sufficiently separated from the mixed liquid 32. Consequently, the coloring material aggregate 34 is provisionally fixed on the intermediate transfer body 14 in a reliable fashion.

Figure 7B:
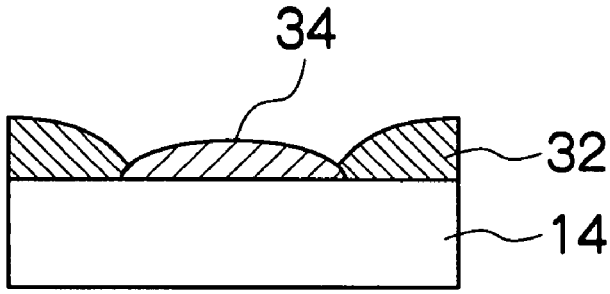
Figure 7C:
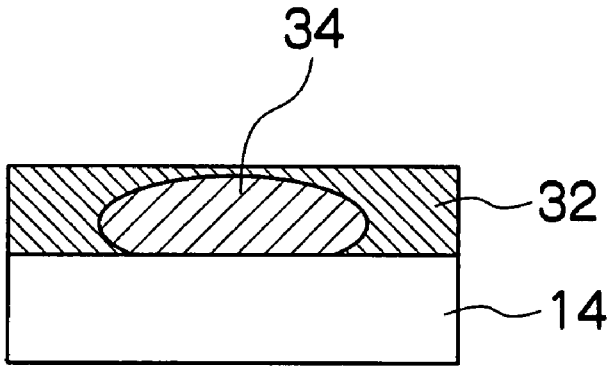
Figure 7D:
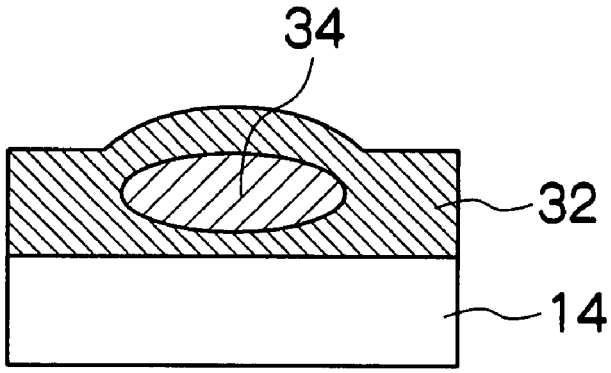

If the relationship of the surface energies is γt<γk, which does not satisfy the condition (5), then as shown in FIG. 7B, the mixed liquid 32 is repelled from the coloring material aggregate 34, although no film of the mixed liquid 32 is formed between the coloring material aggregate 34 and the intermediate transfer body 14; in other words, the coloring material aggregate 34 is directly in contact with the intermediate transfer body 14. If the relationship of the surface energies is γt=γk, which does not satisfy the condition (5), then as shown in FIG. 7C, the coloring material aggregate 34 remains in the same state as the one shown in FIG. 7A. In these cases, the aggregation in the coloring material aggregate 34 does not progress to a sufficient extent.

The mixed liquid 32 is composed of the treatment liquid 30 and the ink liquid 31, and if the above-described condition (2) is satisfied, then there is the following relationship (6):

$$\gamma 2 > \gamma k > \gamma 1. \quad (6)$$

From the above-described conditions (1) to (6), it is possible to deduce the following relationship (7):

$$\gamma t > \gamma k > \gamma 1 \text{ and } \gamma g > \gamma k > \gamma 1. \quad (7)$$

In order for the condition (7) to be always satisfied irrespective of the application ratio of the treatment liquid 30 to the ink liquid 31 on the intermediate transfer body 14, it is preferable that there is the following relationship (8):

$$\gamma t > \gamma 2 > \gamma 1 \text{ and } \gamma g > \gamma 2 > \gamma 1. \quad (8)$$

As described above, when the condition (8) is satisfied, the coloring material aggregate 34 is formed on the intermediate transfer body 14 through the sufficient aggregation, and moreover the tension of the interface between the mixed liquid 32 and the coloring material aggregate 34 that acts upon the coloring material aggregate 34 is small and the coloring material aggregate 34 is not moved. Hence, it is possible to prevent the image disturbance during transferring the image to the recording paper 16.

If the conditions (1) to (8) are satisfied, then the aggregation progresses sufficiently and the coloring material aggregate 34 is provisionally fixed on the intermediate transfer body 14; however, there may remain the mixed liquid 32 between the coloring material aggregate 34 and the intermediate transfer body 14. Hence, in order for the coloring material aggregate 34 to be provisionally fixed directly on the intermediate transfer body 14, it is preferable that there is the following relationship (9) between the surface energy γt of the intermediate transfer body 14 and the surface energy γg of the coloring material aggregate 34:

$$\gamma t > \gamma g. \quad (9)$$

Figure 8A:
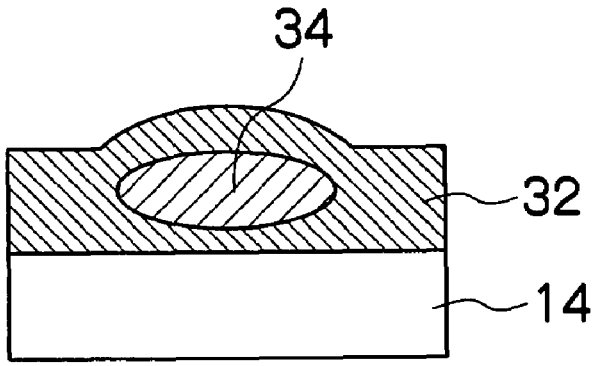
FIGS. 8A to 8D are diagrams for describing relationships between the surface energies of the intermediate transfer body and the coloring material aggregate.

FIG. 8A is a diagram showing an initial state where the coloring material aggregate 34 is formed surrounded by the mixed liquid 32 after the ink liquid 31 is deposited on the treatment liquid 30, the coloring material aggregate 34 is sufficiently separated from the mixed liquid 32, and the aggregation in the coloring material aggregate 34 further progresses. In this case, if the condition (9) is satisfied, then, from the initial state shown in FIG. 8A, the coloring material aggregate 34 spreads and comes into directly contact with the intermediate transfer body 14 so that the total energy is reduced, as shown in FIG. 8D. Consequently, the coloring material aggregate 34 is provisionally fixed directly on the intermediate transfer body 14.

Figure 8B:
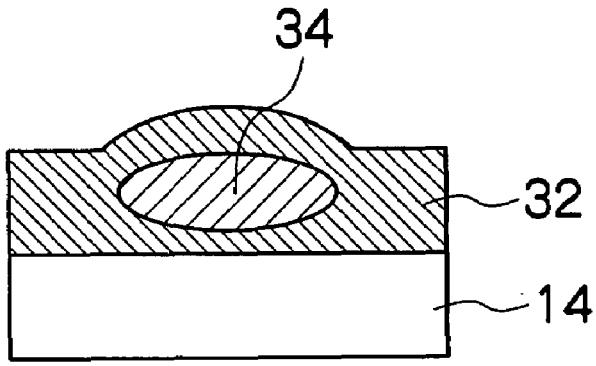
Figure 8C:
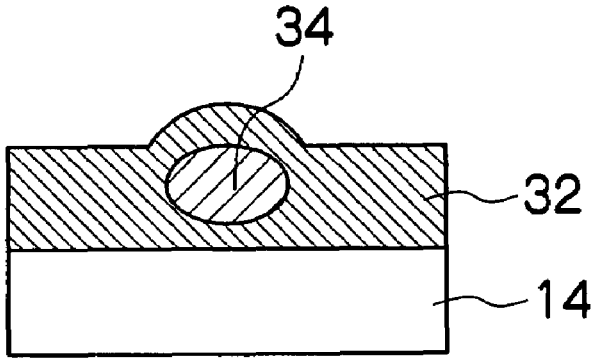
Figure 8D:
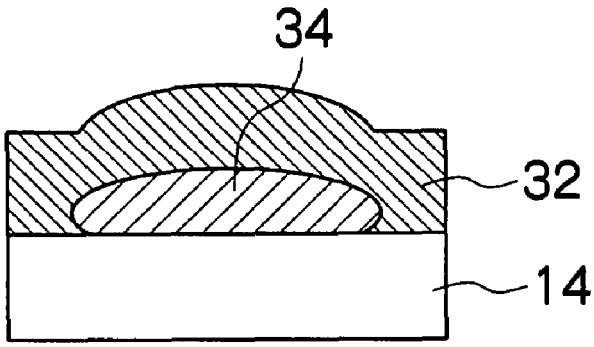

If the relationship of the surface energies is γt=γg, which does not satisfy the condition (9), then after the ink droplet spreads due to the inertial force upon the deposition, the coloring material aggregate 34 is fixed in that state as shown in FIG. 8B. If the relationship of the surface energies is γt<γg, which does not satisfy the condition (9), then the ink droplet contracts against the inertial force upon the deposition, and the coloring material aggregate 34 is fixed in that state as shown in FIG. 8C. In this case, although the coloring material aggregate 34 is provisionally fixed on the intermediate transfer body 14, the interface area between the coloring material aggregate 34 and the intermediate transfer body 14 is small, hence it is not considered that the coloring material aggregate 34 is provisionally fixed directly on the intermediate transfer body 14.

If the relationship of the surface energies is γt>γg, which satisfies the condition (9), then the coloring material aggregate 34 is provisionally fixed directly on the intermediate transfer body 14, and hence it is possible to prevent the image disturbance during transferring the image to the recording paper 16.

In order for all of the above-described conditions to be satisfied, it is preferable that there is the following relationship (10):

$$\gamma t > \gamma g > \gamma 2 > \gamma 1. \quad (10)$$

Figure 9:
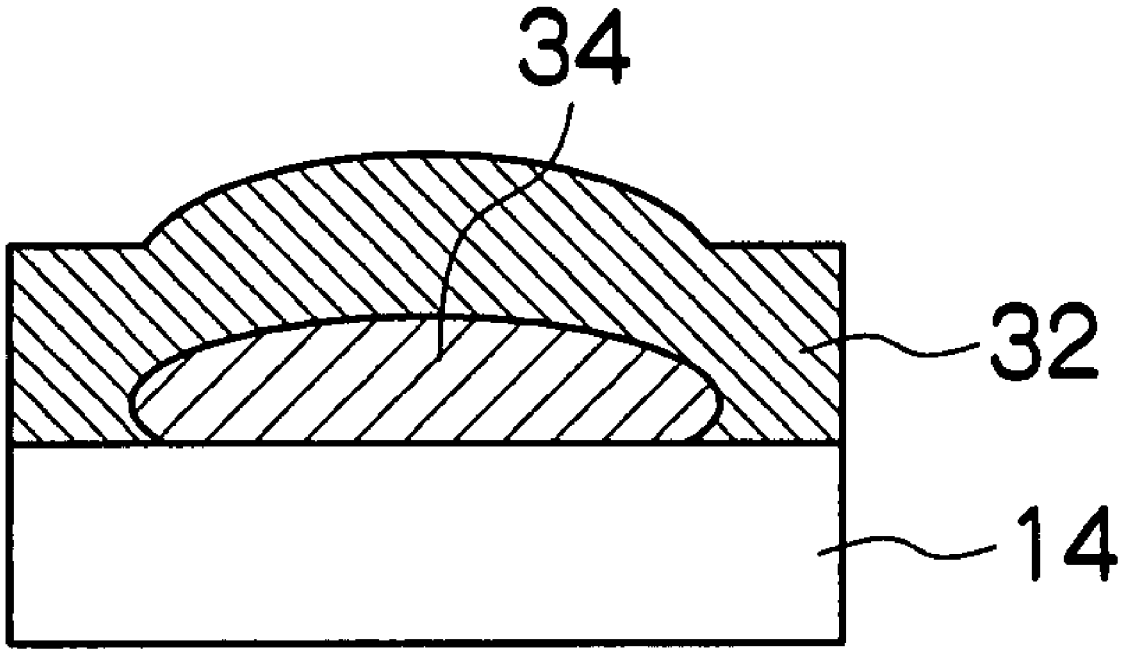
FIG. 9 is a diagram showing a state in which the coloring material aggregate is provisionally fixed on the intermediate transfer body, under a preferable condition.

When the condition (10) is satisfied, then the aggregation progresses to a sufficient extent, no liquid film of the mixed liquid 32 is formed between the coloring material aggregate 34 and the intermediate transfer body 14, the coloring material aggregate 34 is provisionally fixed directly on the intermediate transfer body 14, and the coloring material aggregate 34 wets and spreads satisfactorily over the intermediate transfer body 14 and is provisionally fixed in this spreading state, as shown in FIG. 9.

In order for the above-described conditions to be satisfied, the surface energy γt of the intermediate transfer body 14 is adjusted by means of the characteristics of the material of the intermediate transfer body 14, and the surface energies γk, γ1 and γg of the mixed liquid 32, the treatment liquid 30 and the coloring material aggregate 34 are adjusted by altering the types and/or amounts of pigment, latex and/or surfactant added thereto.

Conditions for Transferring Image to Recording Paper

Next, the conditions during transfer of the image to the recording paper 16 by the transfer device are described below. Of the two transfer rollers 42 and 44 forming the transfer device, the transfer pressurization roller 44 is provided with the heating function in order to perform as a surface energy modification device. In the present embodiment, taking normal temperature to be 25° C., the temperature of the two rollers 42 and 44 is set to 80° C. by the heating function during transferring the image to the recording medium. By setting the temperature of the two rollers 42 and 44 to 80° C. in this way, the intermediate transfer body 14 and the recording paper 16 are heated, resulting in changes of the surface energies of the intermediate transfer body 14 and the recording paper 16. Thus, the condition $\gamma g > \gamma t$ can be satisfied during the image transfer, and the coloring material aggregate 34 becomes more readily transferable from the intermediate transfer body 14 to the recording medium 16, and hence it is possible to prevent the image disturbance from occurring on the recording paper 16.

In the present embodiment, the surface energy adjusting device includes the heating device which carries out heating during transfer, but the present invention is not limited to this, and it is possible that the surface energy adjusting device includes an energy application device such as an ultraviolet irradiation device, a corona charge device, or the like.

First and Second Liquids

The treatment liquid 30 is used as the first liquid, and the ink liquid 31 containing the coloring material 33 that is solvent-insoluble is used as the second liquid. The purpose of the treatment liquid 30 is to prevent the disturbance of the image formed by the ink liquid 31, and the treatment liquid 30 desirably has reaction properties to the ink liquid 31. Here, the term "reaction" means a reaction that raises the viscosity of the ink liquid 31, and includes the aggregation of the coloring material 33 contained in the ink liquid 31. In the present embodiment, the treatment liquid 30 has a low pH, and induces the coloring material 33 contained in the ink liquid 31 to aggregate by a change in pH. It is also possible in another embodiment that the treatment liquid 30 induces the coloring material 33 contained in the ink liquid 31 to aggregate by an ionic reaction. For the coloring material 33, it is possible to use a pigment, a polymer, or a mixture of pigment and polymer. The polymer used in the present embodiment improves the intermediate transfer characteristics, the fixing properties on the recording medium after the image transfer, and the resistance properties against wear.

Examples of pigment usable in the present embodiment include: C.I. Pigment Yellow 12, 13, 17, 55, 74, 97, 120, 128, 151, 155 and 180, C.I. Pigment Red 122, C.I. Pigment Violet 19, C.I. Pigment Red 57:1, 146, and C.I. Pigment Blue 15:3. Examples of polymer usable in the present embodiment include: an acrylic polymer, a urethane polymer, a polyester polymer, a vinyl polymer, a styrene polymer, and the like. Specific examples of the polymer are latexes of: alkyl acrylate copolymer, carboxyl-modified styrene butadiene rubber (SBR), styrene isoprene rubber (SIR), methyl methacrylate butadiene rubber (MBR), and acrylonitrile butadiene rubber (NBR).

The glass transition temperature Tg of the latex contained in the ink liquid has a significant effect during the transfer process, and it is preferable that Tg of the latex is not lower than 50° C. and not higher than 120° C. in view of factors such as the stability at the normal temperature and the transfer characteristics after heating. Moreover, the minimum film-formation temperature (MFT) also has a significant effect on fixing, and the MFT is desirably not higher than 100° C., and more desirably not higher than 80° C. Furthermore, it is preferable that each of the treatment liquid 30 and the ink liquid 31 has a surface tension of 10 to 50 mN/m and a viscosity of 1 to 20 mPa·s, at 25° C. The treatment liquid 30 contains approximately 0.1 wt % of fluoro surfactant so that the contact angle of the treatment liquid 30 on silicone rubber is 65° or less, in order to achieve good affinity with the intermediate transfer body 14.

For example, the treatment liquid 30 is a mixed liquid containing: water (69 wt %), glycerin (20 wt %), diethylene glycol (10 wt %), Olfine E1010 (1 wt %), pH adjuster (trace) and fluoro surfactant (trace).

For example, the ink liquid 31 is a mixed liquid containing: water (59 wt %), pigment (5 wt %), glycerin (20 wt %), diethylene glycol (10 wt %), Olfine E1010 (1 wt %) and the latex (5 wt %), in which the coloring material 33 is constituted of both pigment and polymer.

Here, Olfine is a composite material employing acetylene alcohol and acetylene diol, and it is manufactured by Nissin Chemical Industry.

Another example of the ink liquid 31 is a mixed liquid containing: water (64 wt %), pigment (5 wt %), glycerin (20 wt %), diethylene glycol (10 wt %), and Olfine E1010 (1 wt %), in which the coloring material 33 is constituted of pigment only.

Another example of the ink liquid 31 is a mixed liquid containing: water (64 wt %), glycerin (20 wt %), diethylene glycol (10 wt %), Olfine E1010 (1 wt %), and the latex (5 wt %), in which the coloring material 33 is constituted of polymer only.

Measurement and Evaluation of Displacement of Coloring Material on Intermediate Transfer Body The present inventor carried out measurement and evaluation of the displacement of the coloring material 33 on the intermediate transfer body 14 after conveyance. More specifically, the treatment liquid 30 was applied on the intermediate transfer body 14, and dots of the ink liquid 31 were then formed by an ejection head. Thereupon, the intermediate transfer body 14 was conveyed by approximately 0.5 meters at a speed of 0.5 m/s. The displacement of the dots after performing solvent removal and transfer was measured and evaluated. The concrete details of the evaluation were as described below.

Firstly, before the evaluation of the displacement on the intermediate transfer body 14, the surface energy $\gamma g$ of the coloring material aggregate 34 was measured in the following manner. Although various pigments and/or latexes (polymers) were used for the coloring material 33 composing the coloring material aggregate 34, the following descriptions are made for the measurement method of the surface energy $\gamma g$ of the coloring material aggregate 34 in the case where the ink liquid 31 contained only a latex as the coloring material 33. The measurement method of the surface energy $\gamma g$ of the coloring material aggregate 34 in the case where the ink liquid 31 contained only a pigment as the coloring material 33 is substantially the same. The measurement was carried out at a normal temperature of 25° C.

(1) The ink liquid 31 that contained a latex of 5 wt % or above but did not contain any solvent having a high boiling temperature was prepared. In this case, it was possible to use commercial product of latex as such, since the latex was dispersed in water.

(2) The ink liquid 31 was applied on a PET (polyethylene terephthalate) film by means of a bar coater. The coat thickness was set to approximately 100 μm, and the ink liquid 31 was applied across the PET film as the substrate.

(3) The PET film coated with the ink liquid 31 was then heated to 120° C. by means of a hot plate, thereby sufficiently driving off the water and consequently obtaining a film of the latex on the PET substrate. This latex film was used as a sample of the coloring material 34.

(4) The surface energy of the sample was measured by using the Owens-Wendt method. More specifically, pure water and diiodomethane ($CH_2I_2$) were prepared as reference liquids L1 and L2, and the contact angles $\theta_{L1}$ and $\theta_{L2}$ of the two reference liquids L1 and L2 on the sample were measured by means of a contact angle meter (Dropmaster 500 manufactured by Kyowa Interface Science). Then, the dispersion component $\gamma_s^d$ and the polar component $\gamma_s^p$ of the surface energy were calculated by solving the following simultaneous equations:

$$\begin{cases} a_1\sqrt{\gamma_s^d} + b_1\sqrt{\gamma_s^p} \approx d_1 \\ a_2\sqrt{\gamma_s^d} + b_2\sqrt{\gamma_s^p} \approx d_2, \end{cases}$$

where the parameters of $a_1$, $a_2$, $b_1$, $b_2$, $d_1$, and $d_2$ are known values that can be calculated from the following equations:

$$a_1 = \sqrt{\gamma_{L1}^d},\ b_1 = \sqrt{\gamma_{L1}^p},\ d_1 = \frac{\gamma_{L1}^{total}(1+\cos\theta_{L1})}{2}, \text{ and}$$

$$a_2 = \sqrt{\gamma_{L2}^d},\ b_2 = \sqrt{\gamma_{L2}^p},\ d_2 = \frac{\gamma_{L2}^{total}(1+\cos\theta_{L2})}{2},$$

where the known properties of the reference liquids are as follows: water has the surface energy of the dispersion component $\gamma_{L1}^d$=21.8 mJ/m$^2$, the polar component $\gamma_{L1}^p$=51.0 mJ/m$^2$, and the total $\gamma_{L1}^{total}$=72.8 mJ/m$^2$; and diiodomethane has the surface energy of the dispersion component $\gamma_{L2}^d$=49.5 mJ/m$^2$, the polar component $\gamma_{L2}^p$=1.3 mJ/m$^2$, and the total $\gamma_{L2}^{total}$=50.8 mJ/m$^2$.

Consequently, the surface free energy $\gamma^{total}$ of the sample (the coloring material aggregate 34) was obtained by γhu total=$\gamma_s^d+\gamma_s^p$.

The surface energy γg of the coloring material aggregate 34 was measured as described above, in the case of the ink liquid 31 containing only the latex as the coloring material 33.

In the case of the ink liquid 31 that contains a mixture of a latex and a pigment as the coloring material 33, the surface energy γg of the coloring material aggregate 34 is considered to have an intermediate value between a value in the case of the ink liquid 31 containing only the latex as the coloring material 33, and a value in the case of the ink liquid 31 containing the pigment as the coloring material.

The above is the description of the method of measuring the surface energy γg of the coloring material aggregate 34.

Then, the surface energy γ1 of the treatment liquid 30 and the surface energy γ2 of the treatment liquid 30 were measured by using a surface tensionometer (CBVP-Z manufactured by Kyowa Interface Science) at a normal temperature of 25° C.

The surface energy γt of the intermediate transfer body 14 was measured as described below. All measurements were carried out at a normal temperature of 25° C.

(1) The contact angles of pure water and diiodomethane on a sample were measured by means of a contact angle meter (Dropmaster 500 manufactured by Kyowa Interface Science). Similarly to the method of measuring the surface energy γg of the coloring material aggregate 34, the dispersion component $\gamma_s^d$ and the polar component $\gamma_s^p$ of the surface energy were calculated by the Owens-Wendt method, and the surface energy $\gamma^{total}$ of the intermediate transfer body 14 was obtained by $\gamma^{total}=\gamma_s^d+\gamma_s^p$.

(2) The above-described step (1) was repeated while altering the types of the intermediate transfer body 14. FIG. 10B shows measurement results of the surface energies γt of the samples A to C of the intermediate transfer body 14.

As described above, the surface energies of the coloring material aggregate 34, the treatment liquid 30, the ink liquid 31 and the intermediate transfer body 14 were measured, and thereupon the displacement of the dots on the intermediate transfer body 14 after conveyance was evaluated.

As shown in FIG. 10A, the ink liquid Nos. 1 to 3 were used for measuring the surface energies γg of the coloring material aggregates 34 generated from the ink liquid Nos. 1 to 3. The ink liquid Nos. 1 to 3 respectively contain the coloring materials 33 composed of mixtures of pigments and latexes shown in FIG. 10A. FIG. 10C is a table showing the evaluation results as to the displacement of dots for combinations of the ink liquid Nos. 1 to 3 and the intermediate transfer body 14 (that is the sample A in FIG. 10B), in which other conditions were as follows: the surface energy γ2 of the ink liquid 31 was varied within 31.2 mN/m to 33.3 mN/m; and the surface energy γ1 of the treatment liquid 30 was varied within 18.2 mN/m to 39.1 mN/m.

The evaluation for the displacement of dots was carried out in the following manner: the critical thickness of the mixed liquid 32 above which the dot displacement occurred was measured with arbitrarily varying the film thickness of the mixed liquid 32, which was composed of the solvents of the treatment liquid 30 and the ink liquid 31. The treatment liquid 30 was applied by a bar coater, although it was also able to apply the treatment liquid 30 by an ejection head. The film thickness of the mixed liquid 32 was calculated from: the specific gravities of the treatment liquid 30 and the ink liquid 31; and the weight difference of the sample before and after applying the treatment liquid 30 and the ink liquid 31 on the intermediate transfer body 14.

After applying the treatment liquid 30 on the intermediate transfer body 14, the dot image was then formed at a resolution of 600 dpi×600 dpi by depositing the ink liquid 31, and immediately after that, the dot image was observed through an optical microscope. It was visually judged whether the dots were displaced or not, through the optical microscope, and the above-described critical thickness of the mixed liquid 32 was obtained on the basis of this judgment.

Since the dot displacement was occurring during the observation through the optical microscope, then this visual observation was sufficient to judge whether or not the dots were displaced. The dot displacement was evaluated in the following four criteria: "excellent" if the critical thickness of the mixed liquid 32 above which the dot displacement occurred was not less than 15.0 μm in all evaluation results; "good" if the critical thickness was not less than 9.0 μm and less than 15.0 μm in all evaluation results; "fair" if the critical thickness was 9.0 μm or above in some evaluation results; and "poor" if the critical thickness was less than 9.0 μm in all evaluation results Here, these evaluations for the dot displacement were carried out on the basis of the threshold values of 9.0 μm and 15.0 μm for the following reasons. When droplets of the treatment liquid 30 are deposited at a resolution of 1200 dpi×1200 dpi and each of the droplets has a volume of 2 pl, then the thickness of the treatment liquid 30 amounts to 4.5 μm. Thereafter, to form a solid image, droplets of the ink liquid 31 are deposited on the film of the treatment liquid 30 at a resolution of 1200 dpi×1200 dpi and each of the droplets has a volume of 2 pl, then the thickness of the mixed liquid 32 amounts to 8.9 μm. It is therefore preferable to obtain good images that the film thickness of the mixed liquid 32 is set to at least 8.9 μm when an image is formed by using one ink, and the film thickness of the mixed liquid is set to at least 13.4 μm when an image is formed by using two inks. Hence, the threshold values in the evaluation were set to 9.0 μm and 15.0 μm.

Moreover, the ink liquid 31 containing only a pigment of 5 wt % as the coloring material 33 was prepared. Then, the surface energy γg of the coloring material aggregate 34 was measured in the same manner as the one described above, and the dot displacement was then evaluated. FIG. 11A is a table showing the used pigment and the surface energy γg of the coloring material aggregate 34 that was obtained from the aggregation, and FIG. 11B is a tale showing the evaluation results of the dot displacement.

Furthermore, the ink liquids 31 containing only latexes (5 wt % or above) as the coloring materials 33 were prepared. Then, the surface energy γg of the coloring material aggregate 34 was measured in the same manner as the one described above, and the dot displacement was then evaluated. FIG. 11A is a table showing the relationship between the used latexes and the surface energies γg of the coloring material aggregates 34 that were obtained from the aggregation, and FIG. 12B is a tale showing the evaluation results of the dot displacement.

From these evaluation results, it can be seen that when the above-described condition (8) ($\gamma t>\gamma 2>\gamma 1$ and $\gamma g>\gamma 2>\gamma 1$) is satisfied, then it is possible to provisionally fix the coloring material aggregate 34 on the intermediate transfer body 14 and to thereby prevent the image disturbance, even in the case where the mixed liquid 32 has a film thickness of 9.0 μm or above.

Moreover, it can be seen that when the above-described condition (10) ($\gamma t>\gamma g>\gamma 2>\gamma 1$) is satisfied, then it is possible to provisionally fix the coloring material aggregate 34 on the intermediate transfer body 14 and to thereby obtain an improved image, even in the case where the mixed liquid 32 has a film thickness of 15 μm or above.

Evaluation of Transfer Characteristics

FIGS. 13A and 13B are tables showing conditions and results as to evaluation for the transfer characteristics to the recording medium. The ink liquid 31 having a composition shown in FIG. 13A was prepared. The treatment liquid 30 having the surface tension of 18.2 mN/m was applied to a film thickness of approximately 5 μm by a bar coater on the intermediate transfer body 14, and the ink liquid 31 was deposited to form a substantially solid image on the intermediate transfer body 14. The recording medium 16 (Tokubishi art, manufactured by Mitsubishi Paper Mills) was conveyed, and the image on the intermediate transfer body 14 was transferred to the recording medium 16. Then, the image transferred on the recording medium 16 was visually observed, and the transfer rate (%) was obtained by calculating the ratio of the area in which the image transfer was successful to the total image area. The transfer rate was evaluated in the following criteria: "excellent" if the transfer rate was not less than 90%; "good" if the transfer rate was not less than 60% and less than 90%; and "fair" if the transfer rate was not less than 50% and less than 60%. The evaluations were carried out with varying materials of the intermediate transfer bodies 14, the transfer temperatures and the transfer speeds as shown in FIG. 13B.

It can be seen from the results in FIG. 13B that the larger the surface energy γt of the intermediate transfer body 14 is, the less the transfer rate is. In order to successfully transfer the image, it is preferable that the condition of $\gamma g>\gamma t$ is satisfied at the transfer, and it is more preferable that the condition of $(\gamma g-\gamma t)>20$ mN/m is also satisfied at the transfer.

Structure of Head

Next, the structure of the head is described below. The heads 12P, 12K, 12C, 12M and 12Y each have the same structure, and a reference numeral 50 is hereinafter designated to any of the heads.

Figure 14B:
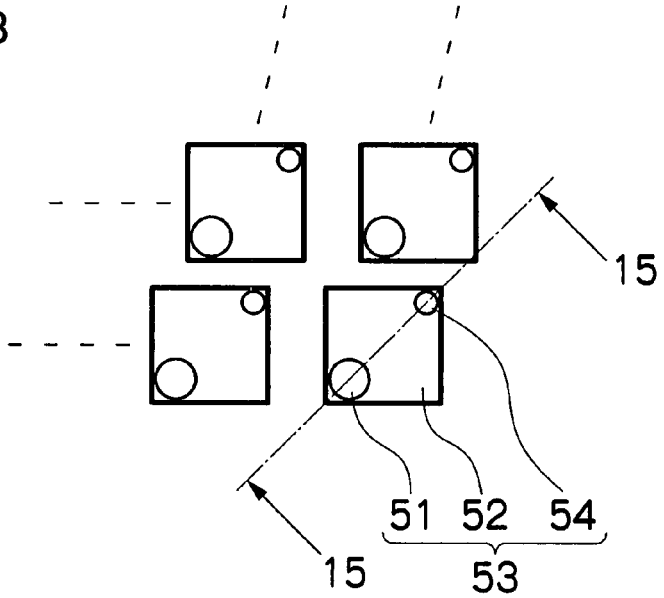
FIG. 14B is an enlarged diagram of a portion of the head.
Figure 14C:
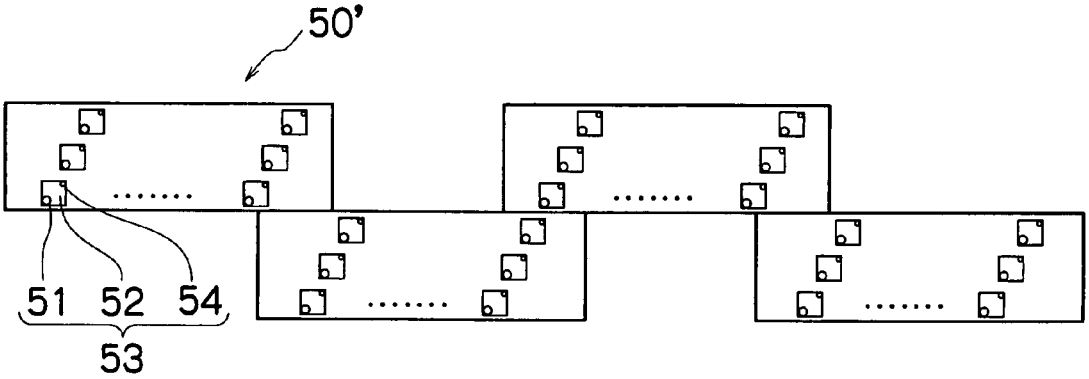
FIG. 14C is a plan view perspective diagram showing a further embodiment of the composition of the head.
Figure 15:
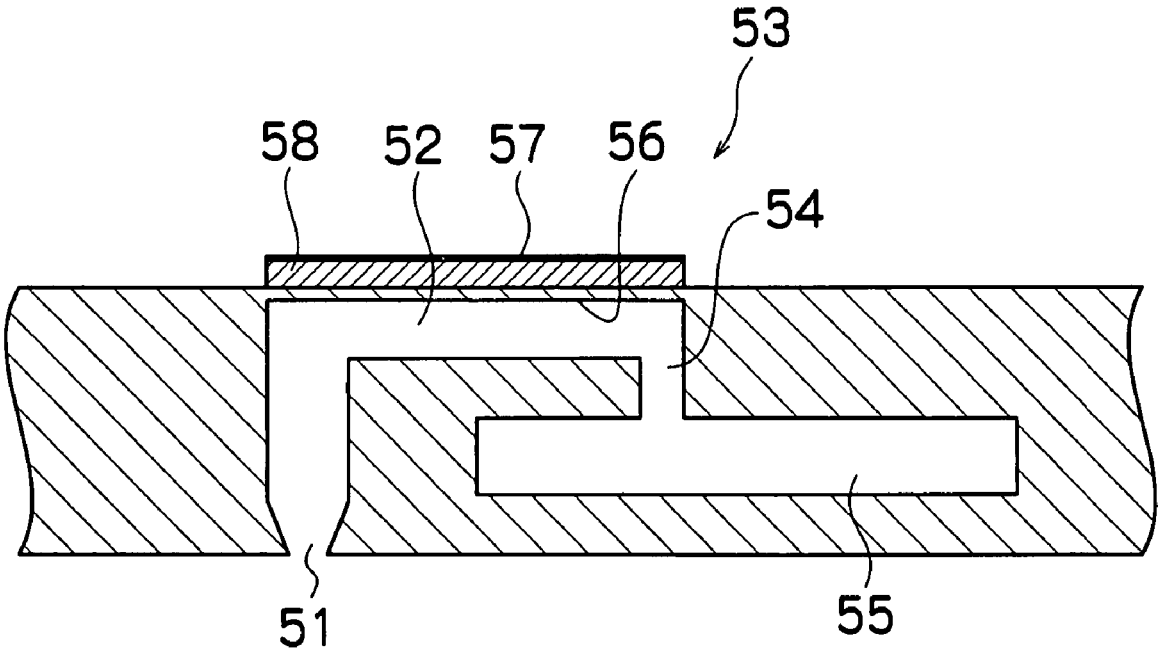
FIG. 15 is a cross-sectional diagram along line 15-15 in FIGS. 14A and 14B.

FIG. 14A is a plan view perspective diagram showing an example of the composition of a head 50, and FIG. 14B is an enlarged diagram of a portion of the head 50. Furthermore, FIG. 14C is a plan view perspective diagram showing a further example of the composition of the head 50. FIG. 15 is a cross-sectional diagram used to illustrate a spatial composition of one liquid droplet ejection element (one ink chamber unit corresponding to one nozzle 51), along line 15-15 in FIGS. 14A and 14B.

The nozzle pitch in the head 50 should be minimized in order to maximize the resolution of the dots printed on the surface of the recording paper 16. As shown in FIGS. 14A and 14B, the head 50 according to the present embodiment has a structure in which a plurality of ink chamber units (droplet ejection elements) 53, each including a nozzle 51 forming an ink ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the conveyance direction of the intermediate transfer body 14) is reduced and high nozzle density is achieved.

The mode of forming one or more nozzle rows through a length corresponding to the entire width of the maximum image output size in a direction substantially perpendicular to the conveyance direction of the intermediate transfer body 14 is not limited to the example described above. For example, instead of the composition in FIG. 14A, a line head having nozzle rows of a length corresponding to the entire width of the recording paper 16 can be formed by arranging and combining, in a staggered matrix configuration, short head modules 50' each having a plurality of nozzles 51 arrayed in a two-dimensional fashion, as shown in FIG. 14C.

As shown in FIGS. 14A and 14B, the planar shape of the pressure chamber 52 corresponding to each nozzle 51 is substantially a square shape, and an outlet port of the pressure chamber 52 connecting to the nozzle 51 is provided at one of the ends of a diagonal line of the planar shape, while an inlet port (supply port) 54 for supplying ink is provided at the other end thereof. The shape of the pressure chamber 52 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 15, each pressure chamber 52 is connected to a common flow channel 55 via the supply port 54. The common flow channel 55 is connected to an ink tank (not shown) that is a base tank for supplying the ink, and the ink supplied from the ink tank is delivered through the common flow channel 55 to the pressure chambers 52.

An actuator 58 provided with an individual electrode 57 is bonded to a pressure plate (a diaphragm that also serves as a common electrode) 56, which forms the surfaces of portions (in FIG. 15, the ceilings) of the pressure chambers 52. When a drive voltage is applied between the individual electrode 57 and the common electrode, the actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the actuator 58 returns from the displacement to its original position after ejecting ink, the pressure chamber 55 is replenished with new ink from the common flow channel 54, via the supply port 52.

Figure 16:
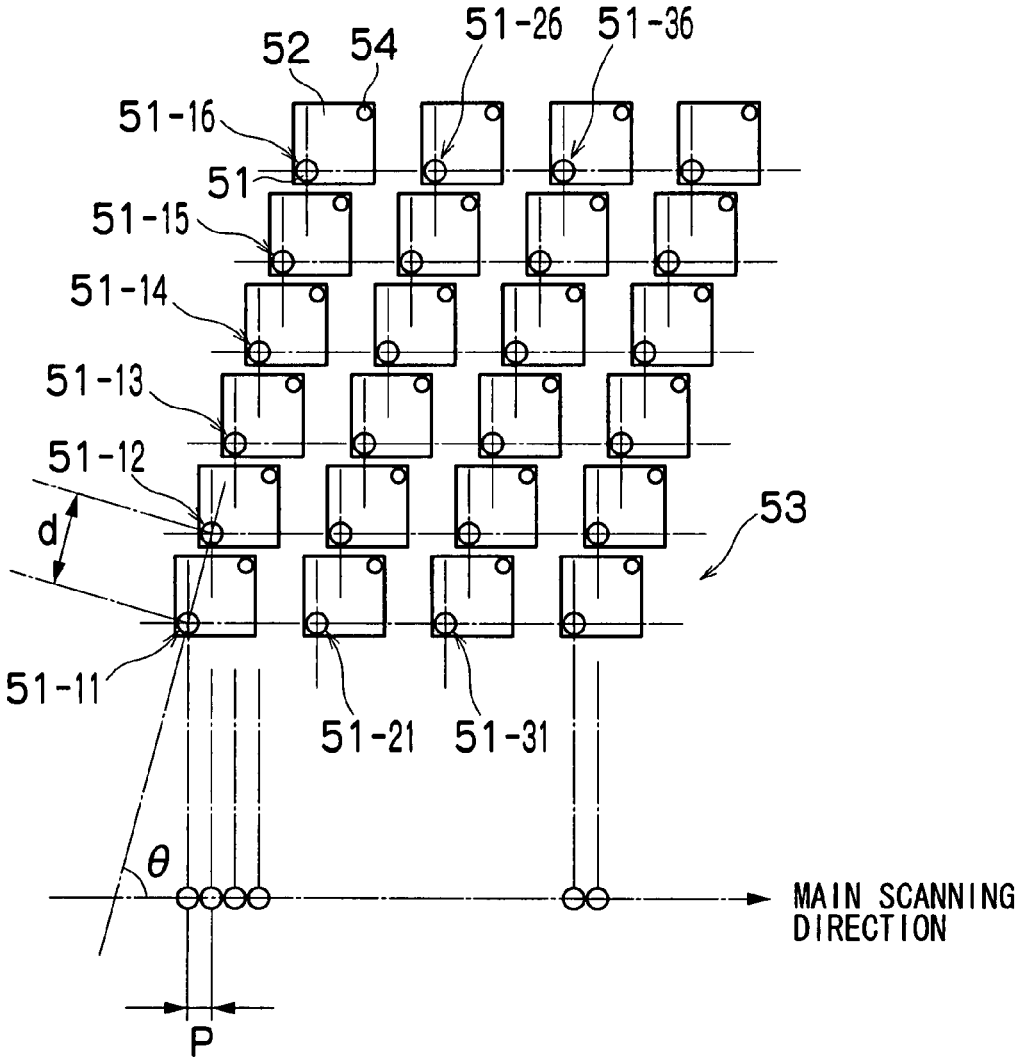
FIG. 16 is an enlarged view showing a nozzle arrangement in the head shown in FIG. 14A.

As shown in FIG. 16, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head including rows of nozzles each having a length corresponding to the entire width of the image recordable width, the "main scanning" is defined as printing one line (a line formed of a row of dots, or a line formed of a plurality of rows of dots) in the width direction of the intermediate transfer body (the direction perpendicular to the conveyance direction of the intermediate transfer body) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix as shown in FIG. 16 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the intermediate transfer body 14 by sequentially driving the nozzles 51-11, 51-12, . . . , 51-16 in accordance with the conveyance velocity of the intermediate transfer body 14.

On the other hand, "sub-scanning" is defined as to repeatedly perform printing of one line (a line formed of a row of dots, or a line formed of a plurality of rows of dots) formed by the main scanning, while moving the full-line head and the intermediate transfer body 14 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the intermediate transfer body 14 is called the sub-scanning direction and the direction perpendicular to same is called the main scanning direction.

In implementing the present invention, the arrangement of the nozzles is not limited to that of the example described above. Moreover, a method is employed in the present embodiment where ink droplets are ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Control System

Figure 17:
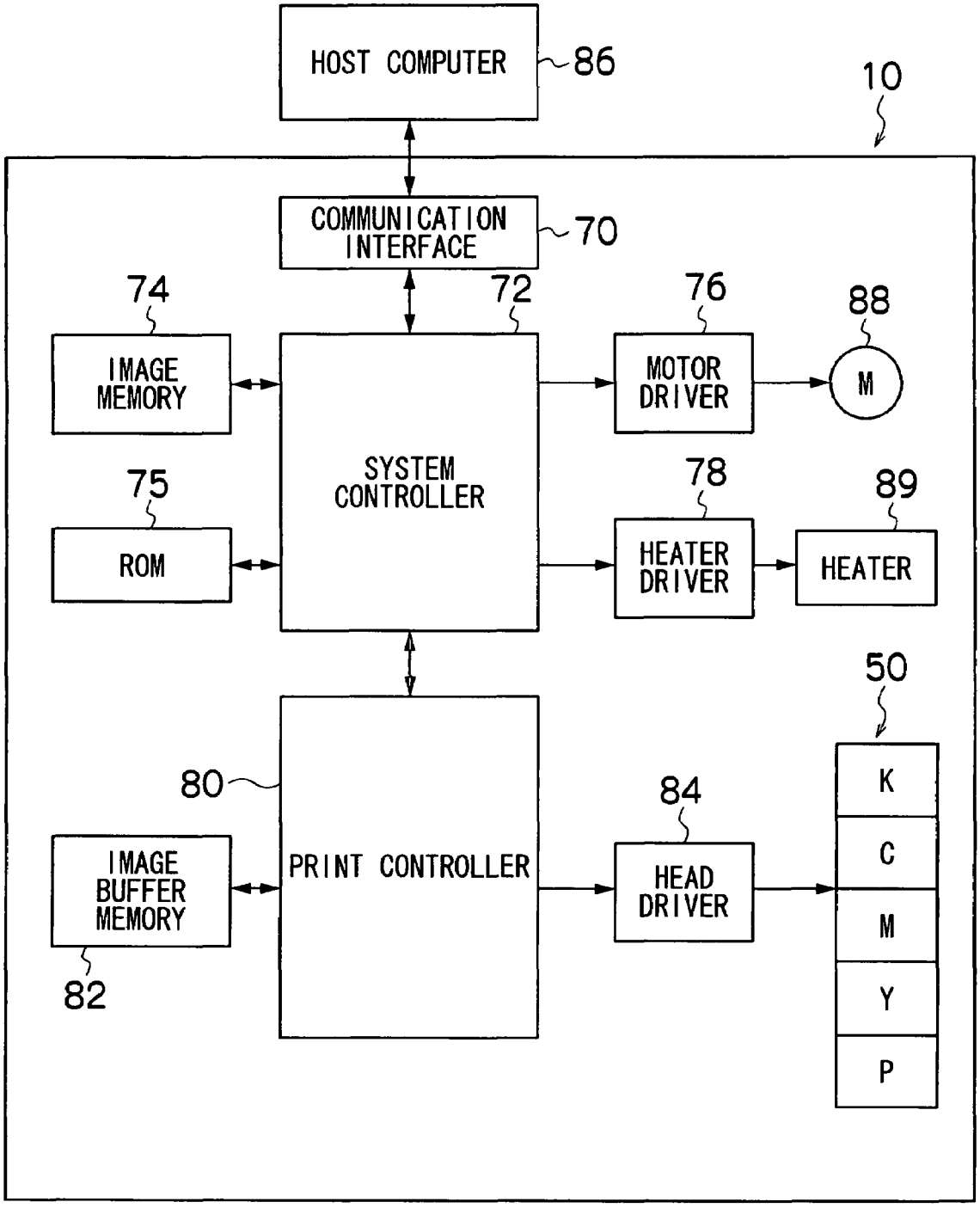
FIG. 17 is a block diagram showing the system composition of the inkjet recording apparatus.

FIG. 17 is a block diagram showing the system configuration of the inkjet recording apparatus 10. As shown in the FIG. 17, the inkjet recording apparatus 10 includes a communication interface 70, a system controller 72, an image memory 74, a ROM 75, a motor driver 76, a heater driver 78, a print controller 80, an image buffer memory 82, a head driver 84, and the like.

The communication interface 70 is an interface unit (image input unit) which functions as an image input device for receiving image data transmitted by a host computer 86. For the communication interface 70, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications.

The image data sent from the host computer 86 is received by the inkjet recording apparatus 10 through the communication interface 70, and is temporarily stored in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74 and ROM 75, and it also generates control signals for controlling the motor 88 and heater 89 of the conveyance system.

The program executed by the CPU of the system controller 72 and the various types of data which are required for control procedures (including data of measurement test pattern for measuring depositing position errors, and the like) are stored in the ROM 75. The ROM 75 may be a non-writeable storage device, or it may be a rewriteable storage device, such as an EEPROM.

The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit (not shown) or the like in accordance with commands from the system controller 72.

The print controller 80 is a control unit which functions as a signal processing device for performing various treatment processes, corrections, and the like, in accordance with the control implemented by the system controller 72, in order to generate a signal for controlling droplet ejection from the image data (multiple-value input image data) in the image memory 74, as well as functioning as a drive control device which controls the ejection driving of the head 50 by supplying the ink ejection data thus generated to the head driver 84.

An image buffer memory 82 accompanies the print controller 80, and image data, parameters, and other data are temporarily stored in the image buffer memory 82 when image data is processed in the print controller 80. FIG. 17 shows a mode in which the image buffer memory 82 is attached to the print controller 80; however, the image memory 74 may also serve as the image buffer memory 82. Also possible is a mode in which the print controller 80 and the system controller 72 are integrated to form a single processor.

To give a general description of the sequence of processing from image input to print output, image data to be printed (original image data) is input from an external source through the communication interface 70, and is accumulated in the image memory 74. At this stage, multiple-value RGB image data is stored in the image memory 74, for example.

In other words, the print controller 80 performs processing for converting the input RGB image data into dot data for the four colors of K, C, M and Y. The dot data generated by the print controller 80 in this way is stored in the image buffer memory 82. This dot data of the respective colors is converted into KCMY droplet ejection data for ejecting ink from the nozzles of each head 50, thereby establishing the ink ejection data to be printed.

The head driver 84 outputs a drive signal for driving the actuators 58 corresponding to the nozzles 51 of the head 50 in accordance with the print contents, on the basis of the ink ejection data and the drive waveform signals supplied by the print controller 80. A feedback control system for maintaining constant drive conditions for the heads may be included in the head driver 84.

By supplying the drive signal output by the head driver 84 to the head 50 in this way, ink is ejected from the corresponding nozzles 51. By controlling ink ejection from the heads 50 in synchronization with the conveyance speed of the intermediate transfer body 14, an image is formed on the intermediate transfer body 14.

As described above, the ejection volume and the ejection timing of the ink droplets from the respective nozzles are controlled via the head driver 84, on the basis of the ink ejection data generated by implementing prescribed signal processing in the print controller 80, and the drive signal waveform. By this means, prescribed dot sizes and dot positions can be achieved.

Beneficial Effects of Embodiments

According to the embodiments of the present invention described above, the inkjet recording apparatus 10 includes: the head 12P, which deposits the treatment liquid 30 containing an aggregating agent on the intermediate transfer body 14; the heads 12K, 12C, 12M and 12Y, which deposit the ink liquids 31 containing the coloring materials 33 that are made to aggregate by the aggregating agent, on the intermediate transfer body 14; and the transfer pressurization rollers 42 and 44, which transfer the image formed on the intermediate transfer body 14 by the coloring material aggregate 34 onto the recording paper 16, wherein the conditions of $\gamma t>\gamma 2>\gamma 1$ and $\gamma g>\gamma 2>\gamma 1$ are satisfied, where $\gamma t$ is the surface energy of the intermediate transfer body 14, $\gamma 1$ is the surface energy of the treatment liquid 30, $\gamma 2$ is the surface energy of the ink liquid 31, and $\gamma g$ is the surface energy of the aggregate of the coloring material aggregate 34.

Since these conditions are satisfied, then the coloring material aggregate 34 is provisionally fixed on the intermediate transfer body 14, and it is therefore possible to prevent the image disturbance during transfer of the image to the recording paper 16. Moreover, it is also possible to handle various types of liquids as the treatment liquid 30 and the ink liquid 31, rather than being limited to oil-based or water-based liquids only. It is also possible to prevent wasted expendable material, and there is no limitation on the recording paper 16 which can be handled, and hence the versatility is high.

In an embodiment of the present invention, by satisfying the condition of $\gamma t>\gamma g$, the coloring material aggregate 34 is fixed provisionally on the intermediate transfer body 14, in a reliable fashion, and hence it is possible to prevent the image disturbance during transfer of an image to the recording paper 16.

In an embodiment of the present invention, the transfer pressurization roller 44 adjusts at least one of the surface energies so that the condition of $\gamma g>\gamma t$ is satisfied during the transfer of the image to the recording paper 16. Hence, the coloring material aggregate 34 becomes more readily transferable to the recording paper 16.

In an embodiment of the present invention, the solvent-insoluble material is a pigment or a polymer. The transfer characteristics to the recording paper 16, as well as the fixing properties and the wear resistance on the recording paper 16 after transfer, is therefore improved.

In an embodiment of the present invention, it is possible to make the treatment liquid 30 wet and spread over the intermediate transfer body 14 by using the head 12P, which is an ejection head based on the inkjet method, as the treatment liquid deposition device.

Moreover, in an embodiment of the present invention, by using the solvent removal unit 26 and the solvent drying unit 28, which remove the solvent from the mixed liquid 32 of the treatment liquid 30 and the ink liquid 31, then it is possible reliably to prevent the image disturbance when transferring an image to the recording paper 16.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an intermediate transfer body;

a first liquid application device which applies a first liquid containing an aggregating agent on the intermediate transfer body;

a second liquid application device which applies a second liquid containing a solvent-insoluble material on the intermediate transfer body, the solvent-insoluble material being induced to form an aggregate by the aggregating agent to form an image on the intermediate transfer body; and a transfer device which transfers the image formed on the intermediate transfer body to a recording medium, wherein conditions of $\gamma t>\gamma 2>\gamma 1$ and $\gamma g>\gamma 2>\gamma 1$ are satisfied, where $\gamma t$ is a surface energy of the intermediate transfer body, $\gamma 1$ is a surface energy of the first liquid, $\gamma 2$ is a surface energy of the second liquid, and $\gamma g$ is a surface energy of the aggregate of the solvent-insoluble material.

2. The image forming apparatus as defined in claim 1, wherein a condition of $\gamma t>\gamma g>\gamma 2>\gamma 1$ is satisfied.

3. The image forming apparatus as defined in claim 1, further comprising a surface energy adjusting device which adjusts at least one of the surface energies $\gamma g$ and $\gamma t$ so that a condition of $\gamma g>\gamma t$ is satisfied when the transfer device transfers the image to the recording medium.

4. The image forming apparatus as defined in claim 1, wherein the solvent-insoluble material is one of a pigment and a polymer.

5. The image forming apparatus as defined in claim 1, the first liquid application device includes an ejection head.

6. The image forming apparatus as defined in claim 1, further comprising a solvent removal device which removes solvent from a mixed liquid of the first liquid and the second liquid.

7. An image forming method of forming an image on a recording medium, the method comprising the steps of:

applying a first liquid containing an aggregating agent on an intermediate transfer body;

applying a second liquid containing a solvent-insoluble material on the intermediate transfer body, the solvent-insoluble material being induced to form an aggregate by the aggregating agent to form an image on the intermediate transfer body, under conditions of $\gamma t>\gamma 2>\gamma 1$ and $\gamma g>\gamma 2>\gamma 1$, where $\gamma t$ is a surface energy of the intermediate transfer body, $\gamma 1$ is a surface energy of the first liquid, $\gamma 2$ is a surface energy of the second liquid, and $\gamma g$ is a surface energy of the aggregate of the solvent-insoluble material; and transferring the image formed on the intermediate transfer body to the recording medium.

* * * * *